US008087670B2

(12) United States Patent
Noguchi et al.

(10) Patent No.: US 8,087,670 B2
(45) Date of Patent: Jan. 3, 2012

(54) SHEET CONVEYING DEVICE AND IMAGE FORMING APPARATUS

(75) Inventors: Hidetaka Noguchi, Hyogo (JP); Toshiyuki Andoh, Kanagawa (JP); Takashi Hodoshima, Kanagawa (JP); Seiji Hoshino, Kanagawa (JP); Takashi Hashimoto, Kanagawa (JP); Tatsuhiko Oikawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 289 days.

(21) Appl. No.: 12/320,821

(22) Filed: Feb. 5, 2009

(65) Prior Publication Data

US 2009/0212491 A1 Aug. 27, 2009

(30) Foreign Application Priority Data

Feb. 26, 2008 (JP) ..... 2008-044225

(51) Int. Cl.
*B65H 5/34* (2006.01)

(52) U.S. Cl. ..... 271/270; 271/264; 271/265.01

(58) Field of Classification Search ..... 271/270, 271/265.01, 265.04, 264
See application file for complete search history.

(56) References Cited

U.S. PATENT DOCUMENTS 5,420,616 A * 5/1995 Suemitsu et al. ..... 347/154
5,561,512 A * 10/1996 Fukano et al. ..... 399/69
5,787,321 A * 7/1998 Nishikawa et al. ..... 399/69
5,828,939 A * 10/1998 Yoshiuchi et al. ..... 399/388
6,381,441 B1 * 4/2002 Byeon et al. ..... 399/396
7,731,167 B2 * 6/2010 Prim et al. ..... 270/52.22
2003/0062671 A1 * 4/2003 Yasui et al. ..... 271/270
2003/0141653 A1 * 7/2003 Kumamoto et al. ..... 271/262
2006/0246212 A1 * 11/2006 Takahashi et al. ..... 427/8
2006/0249895 A1 * 11/2006 Kern ..... 271/182
2008/0175612 A1 7/2008 Oikawa et al.
2008/0232880 A1 9/2008 Noguchi et al.
2009/0057997 A1 * 3/2009 Hatada et al. ..... 271/270

FOREIGN PATENT DOCUMENTS

JP 10010806 A * 1/1998
JP 2003079177 A * 3/2003
JP 2005-107118 4/2005
JP 2005345531 A * 12/2005

* cited by examiner

*Primary Examiner* — Stefanos Karmis
*Assistant Examiner* — Howard Sanders
(74) *Attorney, Agent, or Firm* — Harness, Dickey & Pierce, P.L.C.

(57) ABSTRACT

A second rotary member is arranged opposite to a first rotary member to form a nip between them. A driving unit drives the first rotary member. A sheet-width measuring unit measures a width of a sheet to be fed into the nip. A speed compensating unit compensates a fluctuation of a rotation speed of the first rotary member occurring when the sheet is fed into the nip. The speed compensating unit adjusts a compensation target value for compensating the fluctuation of the rotation speed of the first rotary member based on the width of the sheet measured by the sheet-width measuring unit.

13 Claims, 23 Drawing Sheets

SHEET CONVEYING DEVICE AND IMAGE FORMING APPARATUS

CROSS-REFERENCE TO RELATED APPLICATIONS

The present application claims priority to and incorporates by reference the entire contents of Japanese priority document 2008-044225 filed in Japan on Feb. 26, 2008.

BACKGROUND OF THE INVENTION

1. Field of the Invention

The present invention relates to a sheet conveying device and an image forming apparatus including the sheet conveying device.

2. Description of the Related Art

Some image forming apparatuses employ intermediate transfer system in which a primary transfer unit primarily transfers a toner image from each of photosensitive elements onto an intermediate transfer medium, thereby forming a full-color image on the intermediate transfer medium, and a secondary transfer unit secondarily transfers the full-color image onto a sheet-like recording medium (hereinafter, "sheet"). The image forming apparatuses can be, for example, printers, facsimiles, and copiers; and the intermediate transfer medium can be, for example, a drum and a belt. The intermediate-transfer image forming apparatuses have an advantage in wide availability of types of the sheet including thin paper, thick paper, postcards, and envelopes.

However, when a sheet with a predetermined value or larger thick (hereinafter, "thick sheet") is fed into the secondary transfer unit, a rotating speed of the intermediate transfer medium, which keeps constant until just before the thick sheet is fed, fluctuates in a short time. This fluctuation results in a distortion of the image by the primary transfer unit.

Some intermediate-transfer image forming apparatus includes a transfer fixing unit that transfers the toner image from the intermediate transfer medium onto the sheet, and, at the same time, fixes the toner image onto the sheet. Even in such image forming apparatuses, when the thick sheet is fed into the transfer fixing unit, the rotating speed of the intermediate transfer medium, which keeps constant until just before the thick sheet is fed, fluctuates in a short time. This fluctuation results in a distortion of the image by the primary transfer unit or the secondary transfer unit.

In a field of image forming apparatuses that transfers the toner image from the photosensitive elements or the intermediate transfer medium onto the sheet, with the downsizing of the image forming apparatuses, a transfer unit tends to be arranged closely to a fixing unit. In some image forming apparatuses, especially, the toner image is transferred onto the sheet, and, at the same time, fixed onto the sheet. Even in such image forming apparatuses, when the thick sheet is fed into the fixing unit, the rotating speed of a fixing roller or a fixing belt, which keeps constant until just before the thick sheet is fed, fluctuates in a short time. This fluctuation causes non-smooth conveying of the sheet, which results in a distortion of the image by the transfer unit.

Japanese Patent Application Laid-open No. 2005-107118 discloses a technology for suppressing the fluctuation in the rotating speed of the intermediate transfer medium occurring when the sheet is fed into the secondary transfer unit, i.e., a nip between the intermediate transfer medium and a secondary transfer roller. More particularly, the speed compensation is started at predetermined proper timing so that the rotating speed of the intermediate transfer medium is increased from a standard value by a predetermined offset value. Because an amount of the fluctuation depends on thickness of the sheet, the speed compensation is performed in consideration of the thickness of the sheet that is fed into the secondary transfer unit. Thus, occurrence of the fluctuation in the rotating speed is suppressed properly in consideration of the thickness of the sheet. As a result, the rotating speed of the intermediate transfer medium keeps constant.

However, inventors of the present application found that, even if the thickness of the sheet is fixed, the amount of the fluctuation in the rotating speed occurring when the sheet is fed into the secondary transfer unit is variable depending on width of the sheet. Assume, for example, that an A4-size sheet is fed into the secondary transfer unit or the like in the portrait orientation in a first case and the same sheet is fed in the landscape orientation in a second case. The amount of the fluctuation in the rotating speed in the first case is different from the amount of the fluctuation in the second case. Therefore, to compensate the fluctuation in the rotating speed of the intermediate transfer medium or the like properly, it is necessary to use the offset value that is adjusted in consideration of the sheet width.

Moreover, even if the sheet thickness and the sheet width are fixed, the amount of the fluctuation in the rotating speed of the intermediate transfer medium or the like occurring when the sheet is fed into the secondary transfer unit or the like is variable depending on a sheet conveying speed. Therefore, if the image forming apparatus can selectively change the sheet conveying speed, it is necessary to use the offset value that is adjusted in consideration of the sheet conveying speed to properly compensate the fluctuation in the rotating speed of the intermediate transfer medium or the like.

Still moreover, if the sheet width, the sheet thickness, and the sheet conveying speed are not fixed, it is necessary to use the offset value that is adjusted in consideration of all the sheet width, the sheet thickness, and the sheet conveying speed to properly compensate the fluctuation in the rotating speed of the intermediate transfer medium or the like.

SUMMARY OF THE INVENTION

It is an object of the present invention to at least partially solve the problems in the conventional technology.

According to one aspect of the present invention, there is provided a sheet conveying device including a first rotary member of which a surface makes an endless movement, a second rotary member of which a surface makes an endless movement being arranged opposite to the surface of the first rotary member, and a driving unit that drives the first rotary member. The sheet conveying device conveys a sheet by nipping it in a nip formed by bringing the surface of the first rotary member and the surface of the second rotary member into contact. The sheet conveying device further includes a sheet-width measuring unit that measures a width of the sheet perpendicular to a direction of conveying the sheet; and a speed compensating unit that compensates a fluctuation of a rotation speed of the first rotary member occurring when the sheet is fed into the nip. The speed compensating unit adjusts a compensation target value for compensating the fluctuation of the rotation speed of the first rotary member based on the width of the sheet measured by the sheet-width measuring unit.

Furthermore, according to another aspect of the present invention, there is provided a sheet conveying device including a first rotary member of which a surface makes an endless movement, a second rotary member of which a surface makes an endless movement being arranged opposite to the surface of the first rotary member, and a driving unit that drives the first rotary member. The sheet conveying device conveys a sheet by nipping it in a nip formed by bringing the surface of the first rotary member and the surface of the second rotary member into contact. The sheet conveying device further includes a conveying-speed measuring unit that measures a conveying speed of conveying the sheet; and a speed compensating unit that compensates a fluctuation of a rotation speed of the first rotary member occurring when the sheet is fed into the nip. The speed compensating unit adjusts a compensation target value for compensating the fluctuation of the rotation speed of the first rotary member based on the conveying speed measured by the conveying-speed measuring unit.

Moreover, according to still another aspect of the present invention, there is provided an image forming apparatus including an image carrier on which a toner image is formed; a transfer unit that transfers the toner image from the image carrier onto a sheet; and a fixing unit that fixes the toner image transferred onto the sheet. At least one of the transfer unit and the fixing unit includes the sheet conveying device according to the present invention.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
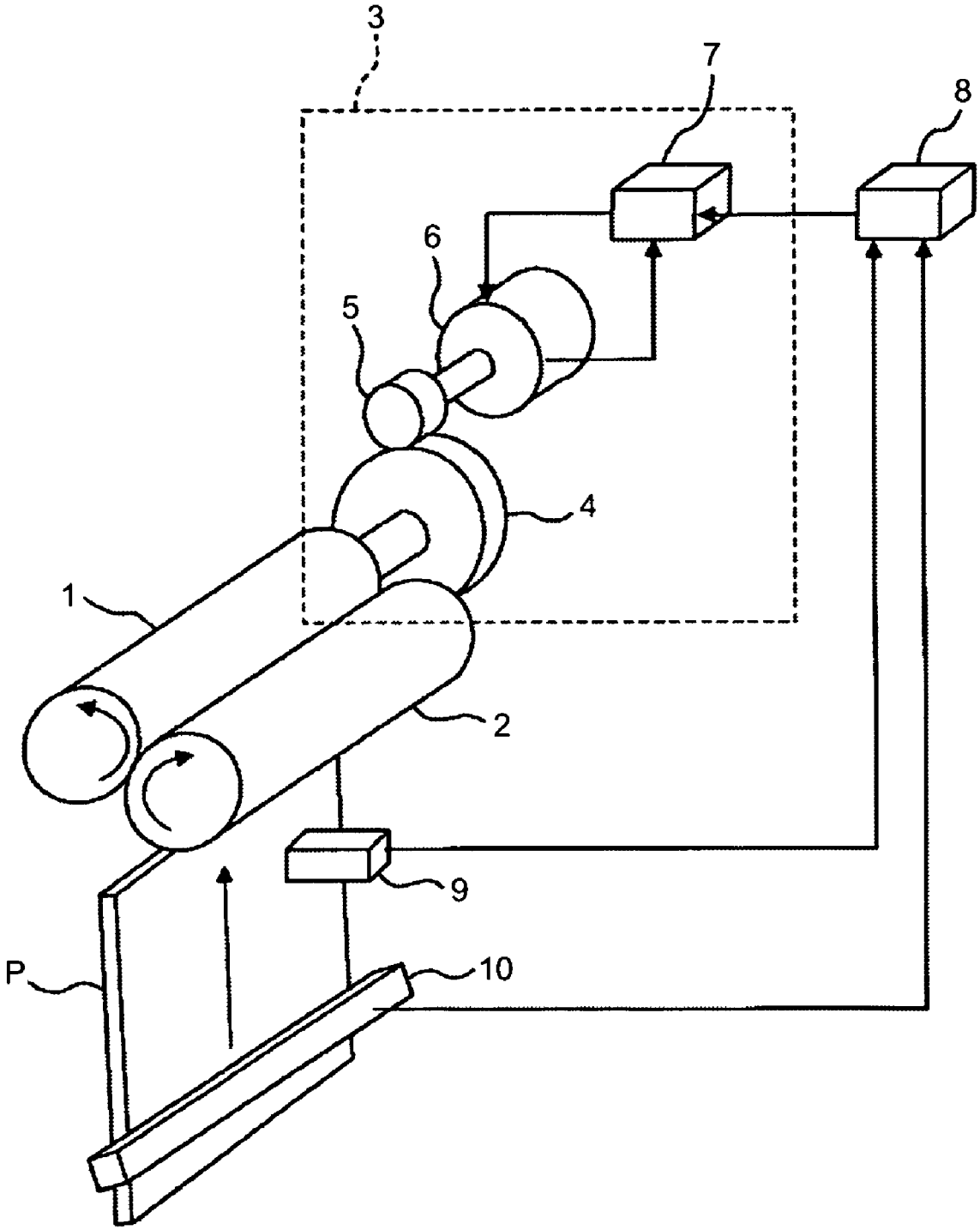
FIG. 1 is a schematic diagram of a sheet conveying device according to a first embodiment of the present invention.

FIG. 1 is a schematic diagram of a sheet conveying device according to a first embodiment of the present invention. A pressure roller 2 comes in contact with a driving roller 1, and thereby nips and conveys a sheet P with the driving roller 1. The sheet P is conveyed toward a top side of FIG. 1. The pressure roller 2 is rotated by a frictional force against the driving roller 1, associated with the rotation of the driving roller 1. A driving unit 3, which is indicated by a dotted frame, drives the driving roller 1. The driving unit 3 includes a large-diameter gear 4, a small-diameter gear 5, a driving source 6, and a driving control unit 7. The driving roller 1 is connected to the driving source 6 via the large-diameter gear 4 and the small-diameter gear 5, and is driven by the driving source 6. The driving source 6 is controlled by the driving control unit 7. The driving control unit 7 controls the driving source 6 using speed data that is fed-back from the driving source 6.

A roller-speed compensating unit 8 starts counting, in response to a detection signal received from a sheet-position detecting unit 9 as a trigger, to measure timing to compensate an expected fluctuation in a rotating speed of the driving roller 1. The roller-speed compensating unit 8 compensates the fluctuation in the rotating speed at that timing when the sheet P is fed into the nip between the driving roller 1 and the pressure roller 2. The roller-speed compensating unit 8 adjusts an offset value in consideration of a width of the sheet P measured by a sheet-width measuring unit 10. The sheet-width measuring unit 10 can be any structure that has been used widely. Assume now that the sheet-width measuring unit 10 includes a plurality of optical sensors arranged in a line perpendicular to a sheet conveying direction. The sheet-width measuring unit 10 measures the sheet width from a pattern of output signals of the sensors.

Although the driving force is transmitted via the gears in the first embodiment, any driving-force transmission members can be used instead of gears such as a gear and a toothed belt, a pulley and a V-belt, or a planet gear. The driving source 6 can be, for example, a brushless direct-current motor, a pulse motor, an ultrasonic motor, or a direct-drive motor. If the driving source 6 is a motor capable of directly transmitting the driving force such as the ultrasonic motor or the direct-drive motor, it is unnecessary to provide the driving-force transmission members. Moreover, if the driving source 6 is the pulse motor or the ultrasonic motor, it is possible to drive the driving source 6 only by open-loop control without using feed-back control.

In the first embodiment, a feedforward control is performed when the sheet P is fed into the nip between the driving roller 1 and the pressure roller 2 to compensate the fluctuation in the rotating speed of the driving roller 1.

Figure 2:
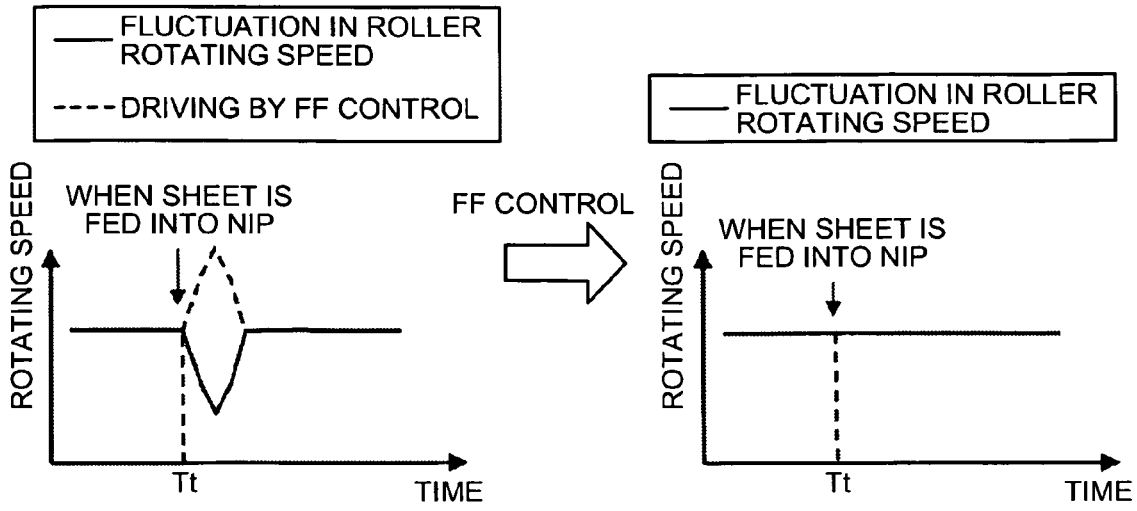
FIG. 2 is a schematic diagram for explaining a concept of feedforward control.

FIG. 2 is a schematic diagram for explaining a concept of the feedforward control. In the feedforward, an offset value (indicated by a broken line of the left figure in FIG. 2) having a phase opposite to the expected fluctuation in the rotating speed of the driving roller 1 (indicated by a full line of the left figure in FIG. 2) is output as a drive-command value to the driving source 6. Because the fluctuation occurs at a timing Tt, i.e., when the sheet P is fed into the nip, the offset value is output at the same timing Tt. As a result, as shown in the right figure in FIG. 2, the fluctuation in the rotating speed of the driving roller 1 is compensated.

Figure 3:
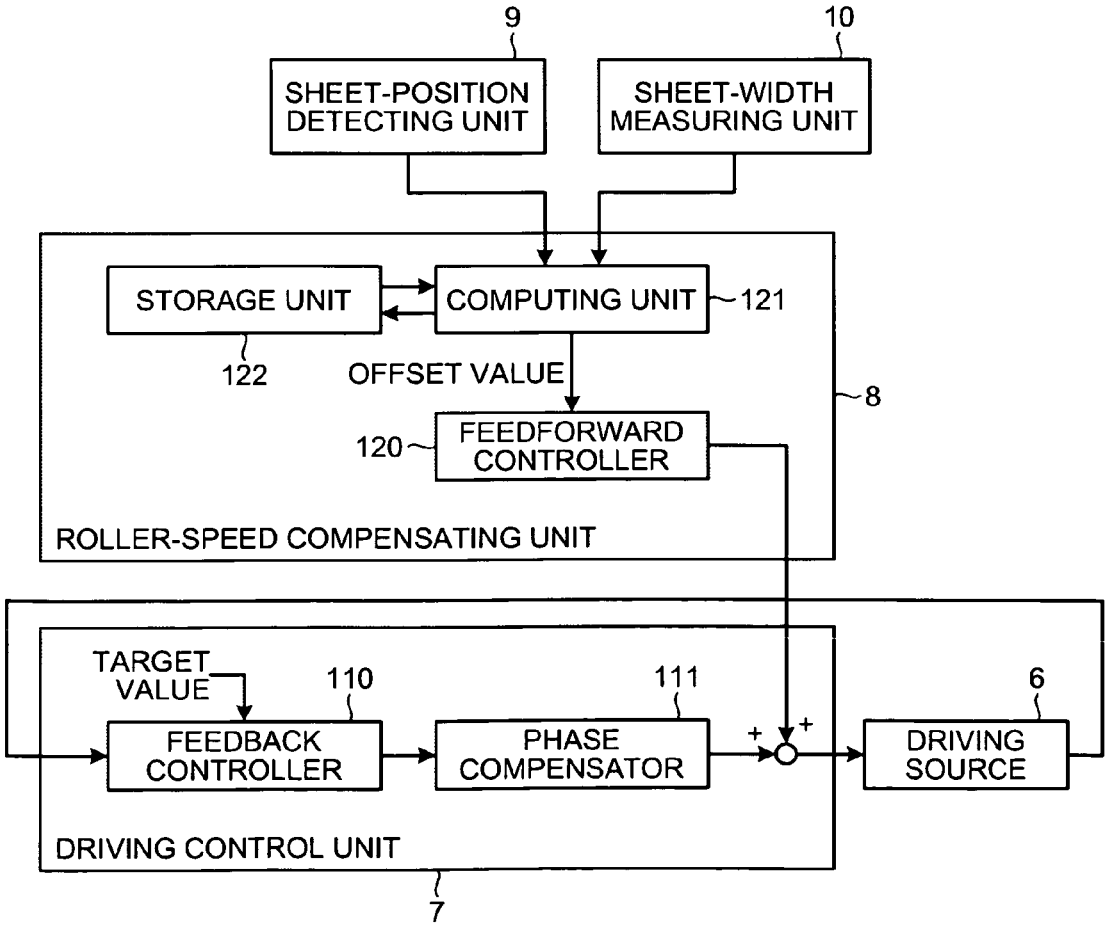
FIG. 3 is block diagram of a driving control unit and a roller-speed compensating unit shown in FIG. 1.

FIG. 3 is block diagram of the driving control unit 7 and the roller-speed compensating unit 8 according to the first embodiment. The driving control unit 7 includes a feedback controller 110 and a phase compensator 111. The roller-speed compensating unit 8 includes a feedforward controller 120, a computing unit 121, and a storage unit 122.

The feedback controller 110 drives the driving source 6 by comparing the current rotating speed received from the driving source 6 with a target speed, and calculating a first drive-command value to close a deviation between the current rotating speed and the target speed. The phase compensator 111 compensates for a gain margin and a phase margin.

Operations of the roller-speed compensating unit 8 are described in detail below. Upon receiving a sheet-width signal from the sheet-width measuring unit 10, the computing unit 121 either reads an offset value corresponding to the width of the sheet P from the storage unit 122 or calculates the offset value from the width of the sheet P. After that, the computing unit 121 receives the detection signal from the sheet-position detecting unit 9, and outputs, when a predetermined time has passed since receiving of the detection signal, the offset value to the feedforward controller 120 so that timing of the feedforward control is matched with timing at which the sheet P is fed into the nip. Data about the predetermined time is pre-stored in the storage unit 122.

Upon receiving the offset value from the computing unit 121, the feedforward controller 120 converts the offset value to a second drive-command value, and outputs the second drive-command value to the driving control unit 7. The first drive-command value of the feedback controller 110 and the second drive-command value of the feedforward controller 120 are added in the driving control unit 7, and the added drive-command value is output to the driving source 6.

The feedforward control is described with reference to FIG. 4. A line A depicts fluctuation of the rotating speed of the driving roller 1 when the sheet P is fed into the nip. A line B depicts signal of the sheet-position detecting unit 9, where the signal turns high when the sheet-position detecting unit 9 detects the sheet P. A line C depicts offset value as an output of the computing unit 121. A line D depicts amount of driving for compensating the fluctuation in the rotating speed of the driving roller 1 by the feedforward control. The sheet P is fed into the nip when a period Ta has been passed since the sheet-position detecting unit 9 detects the sheet P, while the computing unit 121 outputs the signal indicative of the offset value when a period Tb has been passed since the sheet-position detecting unit 9 detects the sheet P. The period Ta is a little longer than the period Tb. A delay period Tc that is a difference between the period Ta and the period Tb is provided as a processing time for both the feedforward controller 120 and the driving control unit 7 and a delay time between when the driving control unit 7 receives the drive-command value from the driving control unit 7 and when the driving control unit 7 is actually driven. In this manner, the timing when the sheet P is fed into the nip is matched with the timing of performing the feedforward control.

Adjusting the offset value in consideration of the width of the sheet P, which is a salient feature of the present invention, is described in detail below.

Figure 5:
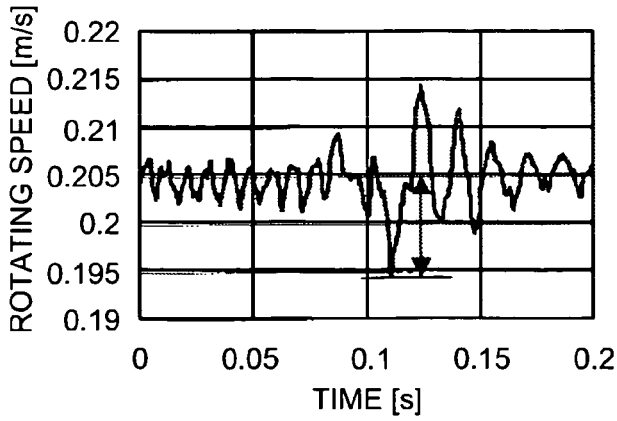
FIG. 5 is a graph of a rotating speed of a driving roller when an A4-size sheet is fed in the landscape orientation.
Figure 6:
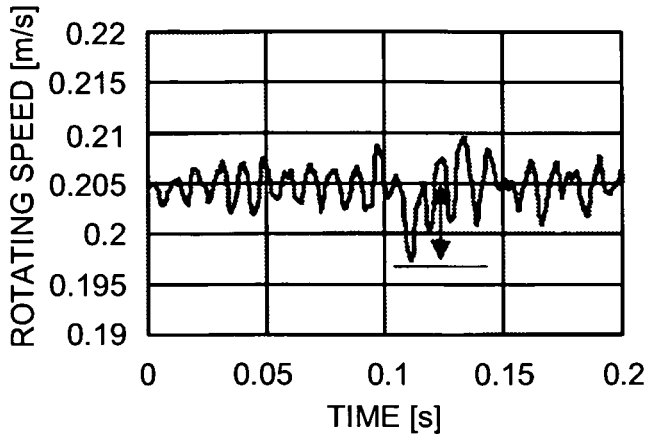
FIG. 6 is a graph of the rotating speed of the driving roller when the A4-size sheet is fed in the portrait orientation.

FIGS. 5 and 6 are graphs of the rotating speed of the driving roller 1 with the roller-speed compensating unit 8 being OFF. The graph shown in FIG. 5 depicts the fluctuation when the sheet P is fed into the nip between the driving roller 1 and the pressure roller 2 in the landscape orientation, i.e., with its long side being conveyed ahead. The graph shown in FIG. 6 depicts the fluctuation when the sheet P, i.e., sheet with the same thickness is fed into the nip in the portrait orientation, i.e., with its short side being conveyed ahead. Assume now that the sheet P is A4 size.

Figure 7:
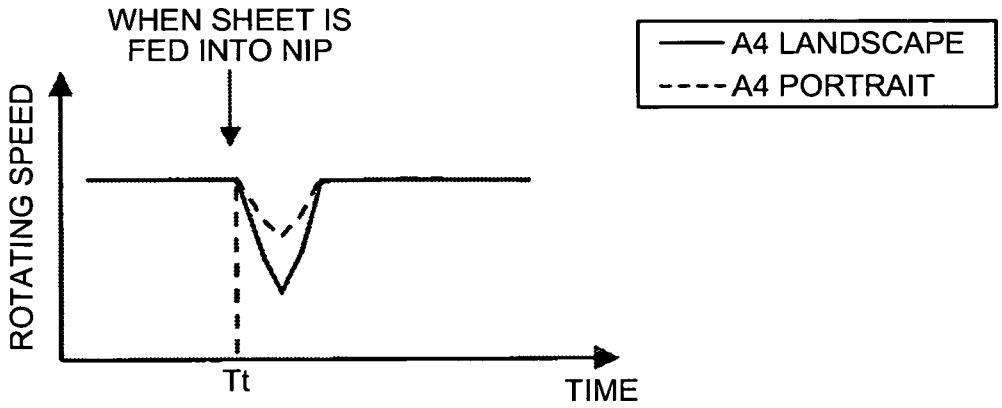
FIG. 7 is a graph depicting fluctuation in the rotating speed of the driving roller when the sheet is fed in various orientations.

It is clear from FIGS. 5 and 6 that, even when the same sheet P is fed, i.e., the sheet thickness is same, the amount of the fluctuation in the rotating speed of the driving roller 1 is variable depending on the sheet width. Therefore, it is necessary to adjust the offset value in consideration of the sheet width. More particularly, as shown in FIG. 7 that is obtained by simplifying the graphs of FIGS. 5 and 6, the amount of the fluctuation when the sheet P is fed with the long side ahead (see a full line of FIG. 7) is larger than the amount of the fluctuation when the sheet P is fed with the short side ahead (see a broken line of FIG. 7). Therefore, because the amount of the fluctuation in the rotating speed of the driving roller 1 depends on the width of the sheet P, it is necessary to adjust the offset value in consideration of the sheet width to obtain the correct second drive-command value as output to the driving source 6 for compensating the expected fluctuation.

There are two approaches to adjust the offset value in consideration of the width of the sheet P. The first approach is to store in the storage unit 122 various offset values each corresponding to a given sheet width. Upon receiving the sheet-width data of the sheet P from the sheet-width measuring unit 10, the computing unit 121 selects one from among the various offset values stored in the storage unit 122 corresponding to the measured sheet width, and outputs the selected offset value to the feedforward controller 120. The second approach is to store in the storage unit 122 a reference offset value corresponding to a reference sheet width and a relational expression $y=f(x)$, where y is amount of the fluctuation in the rotating speed of the driving roller 1 and x is width of the sheet P. Meanwhile, the relational expression is obtained from experiments or calculation. Upon receiving the sheet-width data of the sheet P from the sheet-width measuring unit 10, the roller-speed compensating unit 8 calculates the proper offset value from the sheet-width data and the relational expression, and outputs the calculated offset value to the feedforward controller 120. The first approach can be implemented with a relatively simple software program because no computing process is required. The second approach is advantageous in remarkably reducing the necessity minimum capacity of the storage unit.

Figure 8:
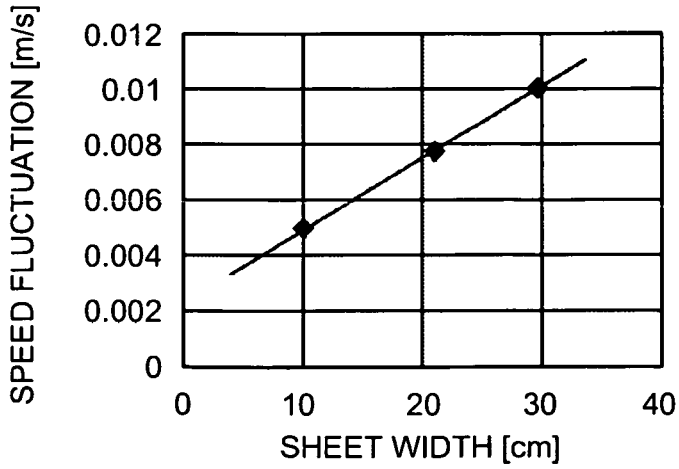
FIG. 8 is a graph of a relation between sheet width and amount of the fluctuation in the rotating speed of the driving roller.

FIG. 8 is a graph of a relation between width of the sheet P and amount of the fluctuation in the rotating speed of the driving roller 1. This graph is obtained from an experiment. As shown in FIG. 8, the width of the sheet P is substantially in proportion to the amount of the fluctuation in the rotating speed of the driving roller 1. Meanwhile, the relation between width of the sheet P and amount of the fluctuation in the rotating speed of the driving roller 1 is not limited to the proportional expression. It is allowable to store any form of relational expression in the storage unit 122 as the relational expression of $y=f(x)$.

In this manner, the sheet conveying device according to the first embodiment measures the width of the sheet P and uses the proper offset value corresponding to the measured sheet width. Therefore, even if the width of the sheet P is not fixed, the fluctuation in the rotating speed of the driving roller 1 is compensated correctly by the feedforward control.

In some cases where the width of the sheet P is not large enough, it is unnecessary to perform the speed compensation by the feedforward control according to the first embodiment, because the amount of the fluctuation in the rotating speed of the driving roller 1 is too small to cause a distortion of the image. More particularly, a predetermined value with regard to the sheet width is stored in the storage unit 122 as a width threshold. The computing unit 121 compares the width of the sheet P measured by the sheet-width measuring unit 10 with the width threshold. The roller-speed compensating unit 8 stops performing the speed compensation, if the measured sheet width is equal to or smaller than the width threshold. This configuration is advantageous in reducing the necessity minimum capacity of the storage unit and the load on the computing unit.

Figure 9:
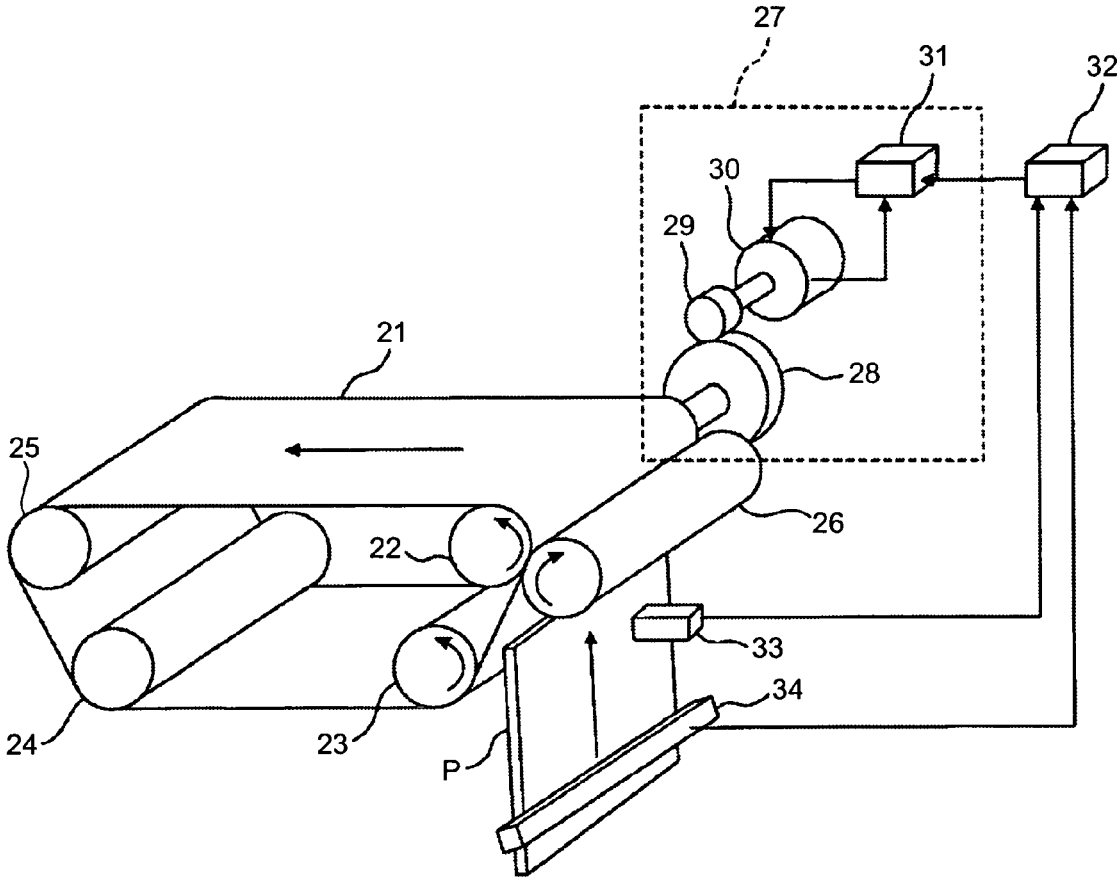
FIG. 9 is a schematic diagram of a sheet conveying device according to a second embodiment of the present invention.

FIG. 9 is a schematic diagram of a sheet conveying device according to a second embodiment of the present invention. The sheet conveying device according to the second embodiment has the structure same as the sheet conveying device according to the first embodiment except that the sheet conveying device according to the second embodiment includes an endless belt 21 and a plurality of support rollers 23, 24, and 25. The endless belt 21 is arranged over a driving roller 22 and the support rollers 23, 24, and 25, and is rotated by the driving roller 22.

The support roller 25 supports the endless belt 21 in such a manner that the endless belt 21 keeps a constant tension. More particularly, by exertion of an elastic member (not shown) such as a spring, the support roller 25 comes in contact with an inner surface of the endless belt 21, pressing the endless belt 21 outward.

A pressure roller 26 and the driving roller 22, that are opposed to each other, form a nip between which the endless belt 21 is arranged. As shown in FIG. 9, the sheet P is fed upward into between the endless belt 21 and the pressure roller 26, and then conveyed. The pressure roller 26 is rotated by a frictional force against the endless belt 21, associated with the rotation of the endless belt 21. A driving unit 27, which is indicated by a dotted frame, drives the driving roller 22. The driving unit 27 includes a large-diameter gear 28, a small-diameter gear 29, a driving source 30, and a driving control unit 31. The driving roller 22 is connected to the driving source 30 via the large-diameter gear 28 and the small-diameter gear 29, and is driven by the driving source 30. The driving source 30 is controlled by the driving control unit 31. The driving control unit 31 controls the driving source 30 using speed data that is fed-back from the driving source 30.

A belt-speed compensating unit 32 starts counting, in response to a detection signal received from a sheet-position detecting unit 33 as a trigger, to measure timing to compensate an expected fluctuation in a rotating speed of the endless belt 21. The belt-speed compensating unit 32 compensates the fluctuation in the rotating speed at that timing when the sheet P is fed into the nip between the endless belt 21 and the pressure roller 26. The belt-speed compensating unit 32 adjusts the offset value in consideration of the width of the sheet P measured by a sheet-width measuring unit 34.

Although three support rollers (23, 24, and 25) are shown in FIG. 9, the number of support rollers is not limited to three. Furthermore, the arrangement of the support rollers shown in FIG. 9 is an example, and any arrangement is allowable. Although the driving force is transmitted via the gears in the second embodiment, any driving-force transmission members can be used instead of gears such as a gear and a toothed belt, a pulley and a V-belt, or a planet gear. The driving source 30 can be, for example, a brushless direct-current motor, a pulse motor, an ultrasonic motor, or a direct-drive motor. If the driving source 30 is a motor capable of directly transmitting the driving force such as the ultrasonic motor or the direct-drive motor, it is unnecessary to provide the driving-force transmission members. Moreover, if the driving source 30 is the pulse motor or the ultrasonic motor, it is possible to drive the driving source 30 only by the open-loop control without using the feed-back control. The driving unit 27 that rotates the endless belt 21 is connected to the driving roller 22 in the second embodiment. However, it is allowable to connect the driving unit 27 to any one of the support rollers 23, 24, and 25 instead of the driving roller 22 for driving the endless belt 21.

Operations of the belt-speed compensating unit 32 are same as the operations of the roller-speed compensating unit 8 according to the first embodiment. A method of adjusting the offset value in consideration of the width of sheet P is same as the method described in the first embodiment. Therefore, the same descriptions are not repeated.

Moreover, a method of stop performing the speed compensation by the feedforward control if the width of the sheet P is equal to or smaller than the width threshold is same as the method described in the first embodiment, and the same description is not repeated.

Figure 10:
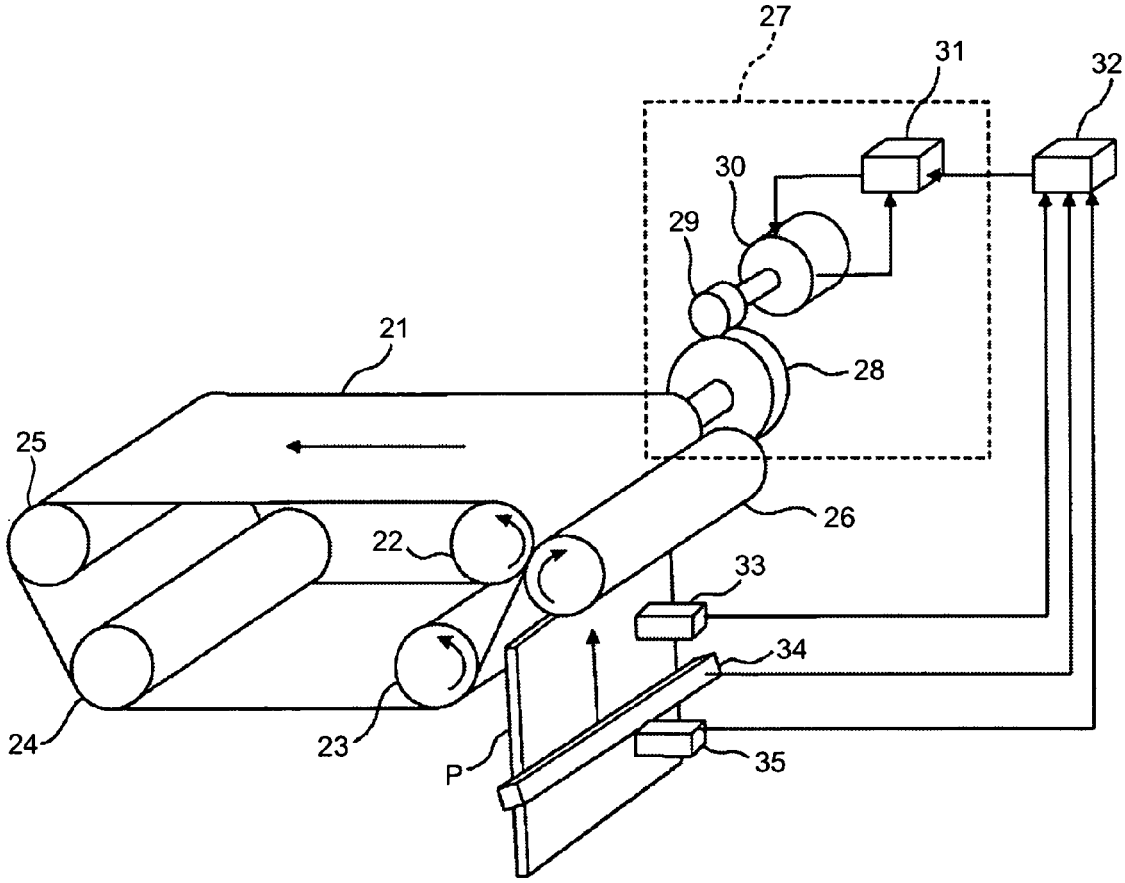
FIG. 10 is a schematic diagram of a sheet conveying device according to a third embodiment of the present invention.
Figure 11:
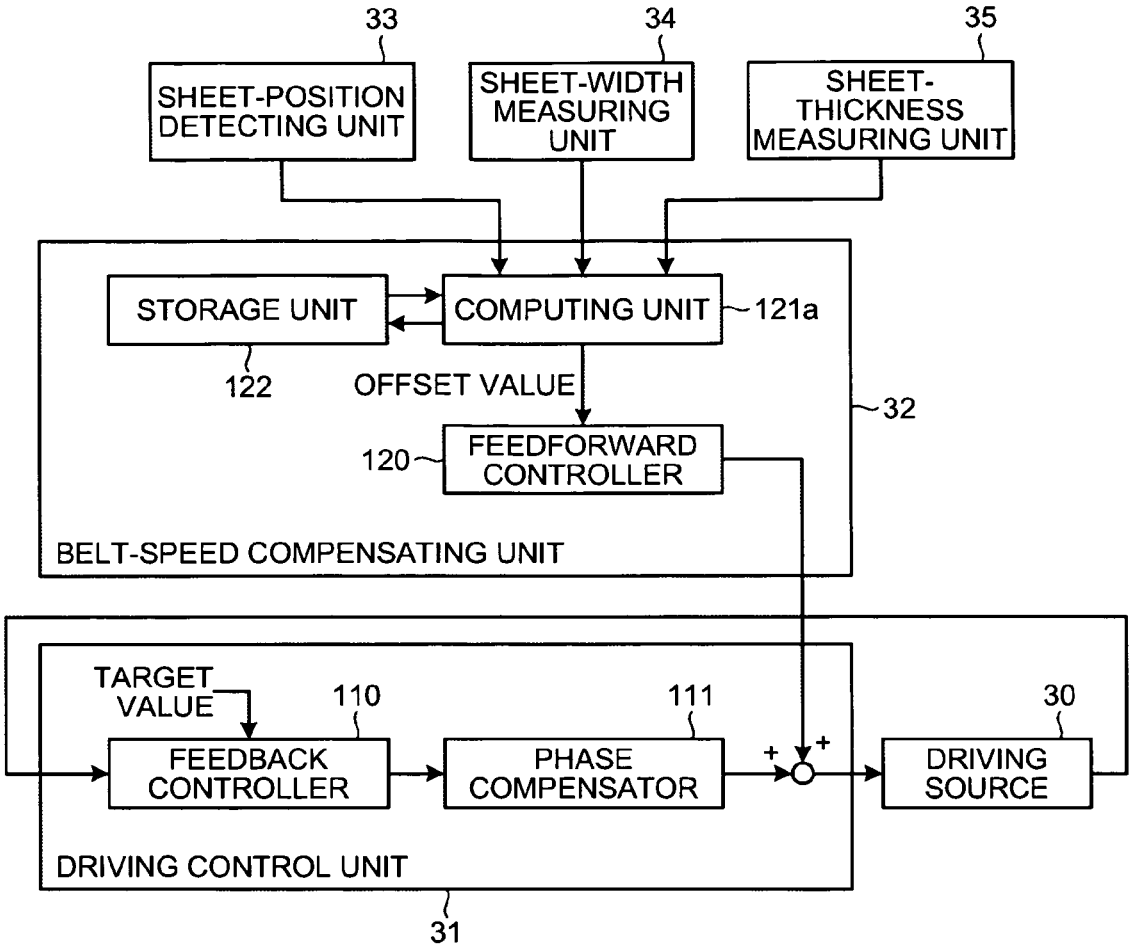
FIG. 11 is a block diagram of a driving control unit and a belt-speed compensating unit shown in FIG. 10.

Although a concept of a sheet conveying device according to a third embodiment of the present invention can be implemented with regardless of the presence of an endless belt, it is assumed that the sheet conveying device according to the third embodiment includes the endless belt 21. FIG. 10 is a schematic diagram of the sheet conveying device according to the third embodiment. FIG. 11 is a block diagram of the driving control unit 31 and the belt-speed compensating unit 32 according to the third embodiment. The sheet conveying device according to the third embodiment has the structure same as the sheet conveying device according to the second embodiment except that the sheet conveying device according to the third embodiment additionally includes a sheet-thickness measuring unit 35 that measures a thickness of the sheet P. Parts corresponding to those in the second embodiment are denoted with the same reference numerals, and the same description is not repeated.

The sheet conveying device according to the third embodiment performs, in the same manner as the sheet conveying device according to the second embodiment, the feedforward control when the sheet P is fed into the nip between the driving roller 22, the endless belt 21, and the pressure roller 26 to compensate the fluctuation in the rotating speed of the driving roller 22.

Operations of the belt-speed compensating unit 32 are described below. Upon receiving signals from the sheet-width measuring unit 34 and the sheet-thickness measuring unit 35, a computing unit 121*a* either reads the offset value corresponding to the width and the thickness of the sheet P from the storage unit 122 or calculates the offset value from the width and the thickness of the sheet P. After that, the computing unit 121*a* receives the detection signal from the sheet-position detecting unit 33, and then outputs, when the predetermined time has passed since receiving of the detection signal, the offset value to the feedforward controller 120.

It has been known that the amount of the fluctuation in the endless belt 21 occurring when the sheet P is fed into the nip between the driving roller 22, the endless belt 21, and the pressure roller 26 depends on the thickness of the sheet P in addition to the width of the sheet P. Therefore, to improve the compensation accuracy in the rotating speed of the endless belt 21 by the feedforward control, it is necessary to adjust the offset value in consideration of both the width and the thickness of the sheet P.

The reason why it is necessary to adjust the offset value in consideration of the thickness of the sheet P is described below.

Figure 12:
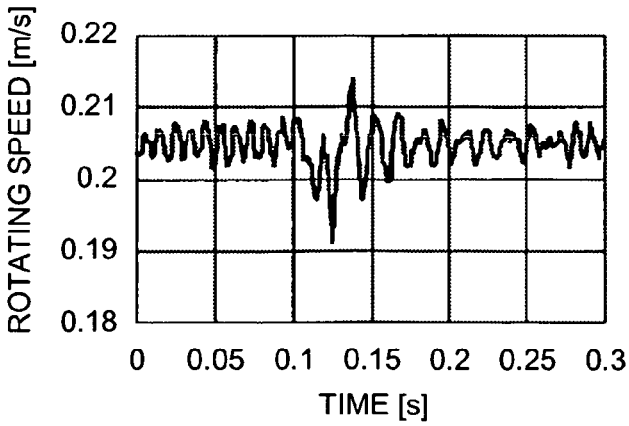
FIG. 12 is a graph of the rotating speed of the driving roller when a sheet with 250 μm thick is fed.
Figure 13:
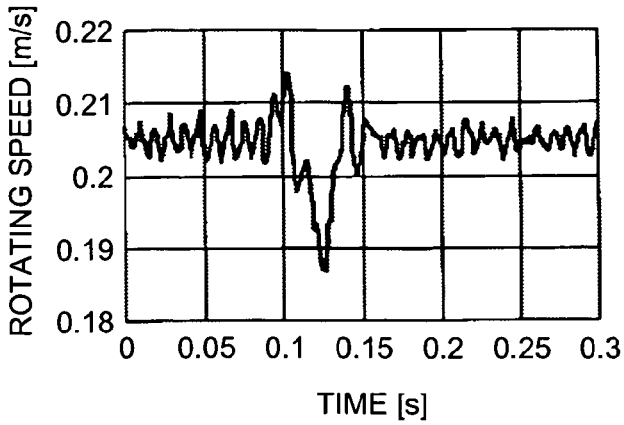
FIG. 13 is a graph of the rotating speed of the driving roller when a sheet with 410 μm thick is fed.

FIGS. 12 and 13 are graph of the rotating speed of the driving roller 22 with the belt-speed compensating unit 32 being OFF. More particularly, the graph shown in FIG. 12 depicts the fluctuation in the rotating speed of the driving roller 22 when a first sheet with 250 μm thick is fed into the nip between the driving roller 22, the endless belt 21, and the pressure roller 26. The graph shown FIG. 13 depicts the fluctuation when a second sheet with 410 μm thick is fed into the nip. The width of the first sheet is equal to the width of the second sheet.

Figure 14:
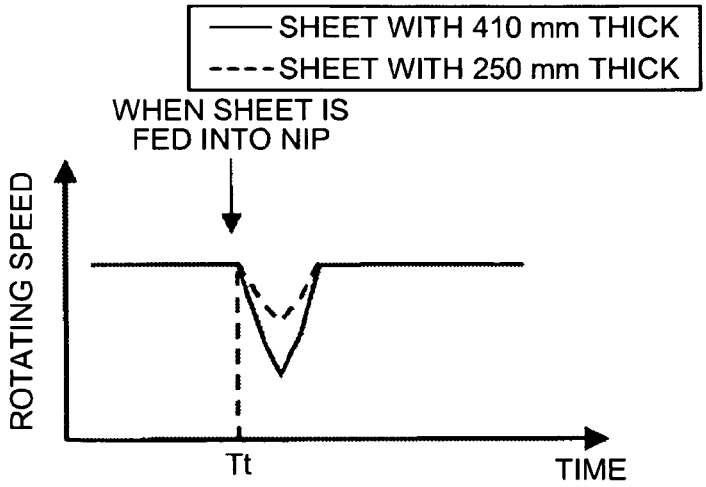
FIG. 14 is a graph depicting the fluctuation in the rotating speed of the driving roller when various sheets having different thickness are fed.

It is clear from FIGS. 12 and 13 that the amount of the fluctuation in the rotating speed of the driving roller 22 depends on the thickness of the sheet P. Therefore, it is necessary to adjust the offset value in consideration of the sheet thickness. More particularly, as shown in FIG. 14 that is obtained by simplifying the graphs of FIGS. 12 and 13, the amount of the fluctuation when the second sheet is fed (see a full line of FIG. 14) is larger than the amount of the fluctuation when the first sheet is fed (see a broken line of FIG. 14). Therefore, because the amount of the fluctuation in the rotating speed of the driving roller 22 depends on the thickness of the sheet P, it is necessary to adjust the offset value in consideration of the sheet thickness to obtain the correct second drive-command value as output to the driving source 30 for compensating the expected fluctuation.

Figure 15:
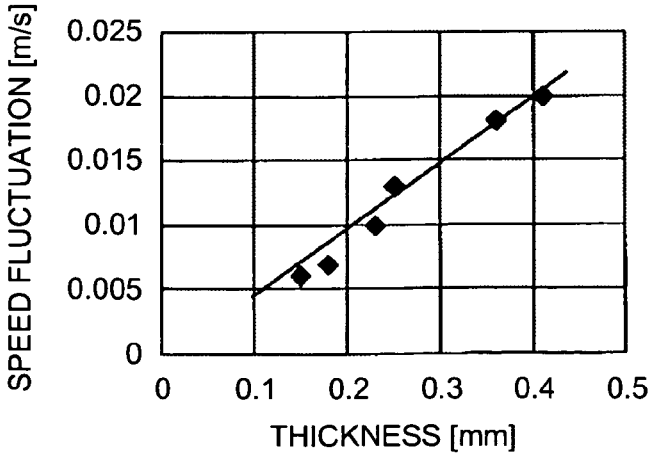
FIG. 15 is a graph of a relation between sheet thickness and amount of the fluctuation in the rotating speed of the driving roller.

FIG. 15 is a graph of a relation between thickness of the sheet P and amount of the fluctuation in the rotating speed of the driving roller 22. This graph is obtained from an experiment. As shown in FIG. 15, the thickness of the sheet P is substantially in proportion to the amount of the fluctuation in the rotating speed of the driving roller 22. Meanwhile, the relation between thickness of the sheet P and amount of the fluctuation in the rotating speed of the driving roller 22 is not limited to the proportional expression, i.e., the relational expression can be any form.

There are three approaches to adjust the offset value in consideration of both the width and the thickness of the sheet P. The first approach is to store in the storage unit 122 various offset values each corresponding to a pattern of the sheet width and the sheet thickness. The second approach is to store in the storage unit 122 a relational expression between the sheet width and the fluctuation in the rotating speed of the endless belt 21 and a relational expression between the sheet thickness and the fluctuation in the rotating speed of the endless belt 21. The offset value is calculated by using those relational expressions each time when the sheet P is conveyed. The third approach is a combination of the first approach and the second approach.

Assume, for example, that the rotating speed of the endless belt 21 is compensated by using the first approach where the sheet width is categorized into three stages and the sheet thickness is categorized into five stages. In this case, 15 various offset values are stored in the storage unit 122. Upon receiving the sheet-width data and the sheet-thickness data from the sheet-width measuring unit 34 and the sheet-thickness measuring unit 35, the computing unit 121*a* selects one from among the 15 offset values corresponding to the measured width and the measured thickness of the sheet P, and outputs the selected offset value.

Assume, for example, that the rotating speed of the endless belt 21 is compensated by using the second approach where two relational expressions are stored in the storage unit 122: a first relational expression of $y_1=f(x_1)$ where $y_1$ is amount of the fluctuation in the rotating speed of the endless belt 21 and $x_1$ is width of the sheet P, and a second relational expression of $y_2=g(x_2)$ where $y_2$ is amount of the fluctuation in the rotating speed of the endless belt 21 and $x_2$ is thickness of the sheet P. The first relational expression is obtained from the experimental result shown in FIG. 8; and the second relational expression is obtained from the experimental result shown in FIG. 15. Upon receiving the sheet-width data from the sheet-width measuring unit 34 and the sheet-thickness data from the sheet-thickness measuring unit 35, the computing unit 121*a* calculates the offset value from the measured width and the measured thickness of the sheet P, and outputs the calculated offset value.

Assume, for example, that the rotating speed of the endless belt 21 is compensated by using the third approach where various offset values each corresponding to a given sheet thickness and the first relational expression are stored in the storage unit 122. Upon receiving the sheet-thickness data from the sheet-thickness measuring unit 35, the computing unit 121*a* reads one from among the various offset values stored in the storage unit 122 corresponding to the measured sheet thickness. Upon receiving the sheet-width data from the sheet-width measuring unit 34, the computing unit 121*a* calculates the offset value from the measured width by using the first relational expression. Thus, the belt-speed compensating unit 32 compensates the rotating speed of the endless belt 21 in consideration of both the width and the thickness of the sheet P.

The third approach is advantageous in reducing both the necessity minimum capacity of the storage unit and the load on the computing unit, if the third approach is used in such a case where the relation between width of the sheet P and amount of the fluctuation in the rotating speed of the endless belt 21 is simple, e.g., a proportional relation but the relation between thickness of the sheet P and amount of the fluctuation in the rotating speed of the endless belt 21 is not simple.

Assume that there are several first relational expressions and a first relational expression to be used is selected depending on the thickness of the sheet P. In this case, the computing unit 121*a* has to select a first relational expression to be used from among the several first relational expressions that are stored in the storage unit 122. Therefore, if the computing power of the computing unit 121*a* is not high enough, the first approach is recommended in this case.

Figure 30:
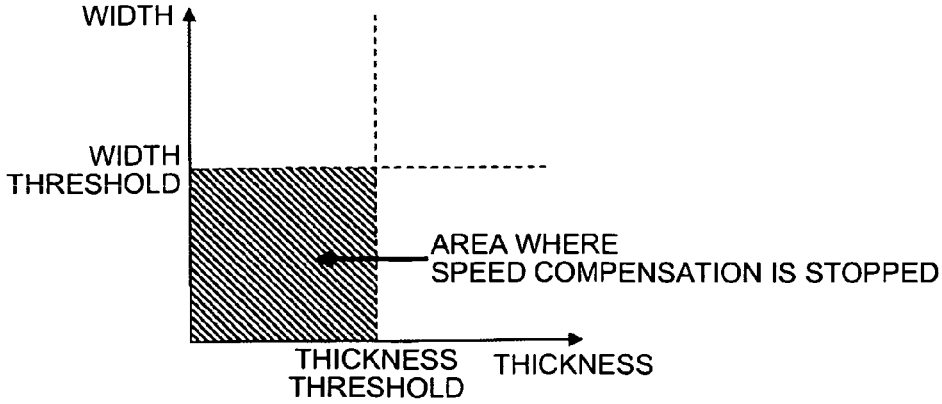
FIG. 30 is a graph depicting an area (width-thickness) where performing of speed compensation is stopped.

In this manner, the sheet conveying device according to the third embodiment adjusts the offset value in consideration with both the width and the thickness of the sheet P. However, in some cases where the width of the sheet P or the thickness of the sheet P is not large enough, it is unnecessary to perform the speed compensation by the feedforward control according to the third embodiment, because the amount of the fluctuation in the rotating speed of the endless belt 21 is too small to cause a distortion of the image. More particularly, a predetermined value with regard to the sheet width or a predetermined value with regard to the sheet thickness is stored in the storage unit 122 as the width threshold or a thickness threshold. The computing unit 121*a* compares the width of the sheet P measured by the sheet-width measuring unit 34 with the width threshold or the thickness of the sheet P measured by the sheet-thickness measuring unit 35 with the thickness threshold. If the measured sheet width is equal to or smaller than the width threshold or the measured sheet thickness is equal to or smaller than the thickness threshold, the belt-speed compensating unit 32 stops performing the speed compensation. This configuration is advantageous in reducing the necessity minimum capacity of the storage unit and the load on the computing unit. Alternatively, the belt-speed compensating unit 32 stops performing the speed compensation, if, as shown in FIG. 30, both the measured sheet width and the measured sheet thickness are equal to or smaller than the threshold thereof.

Figure 16:
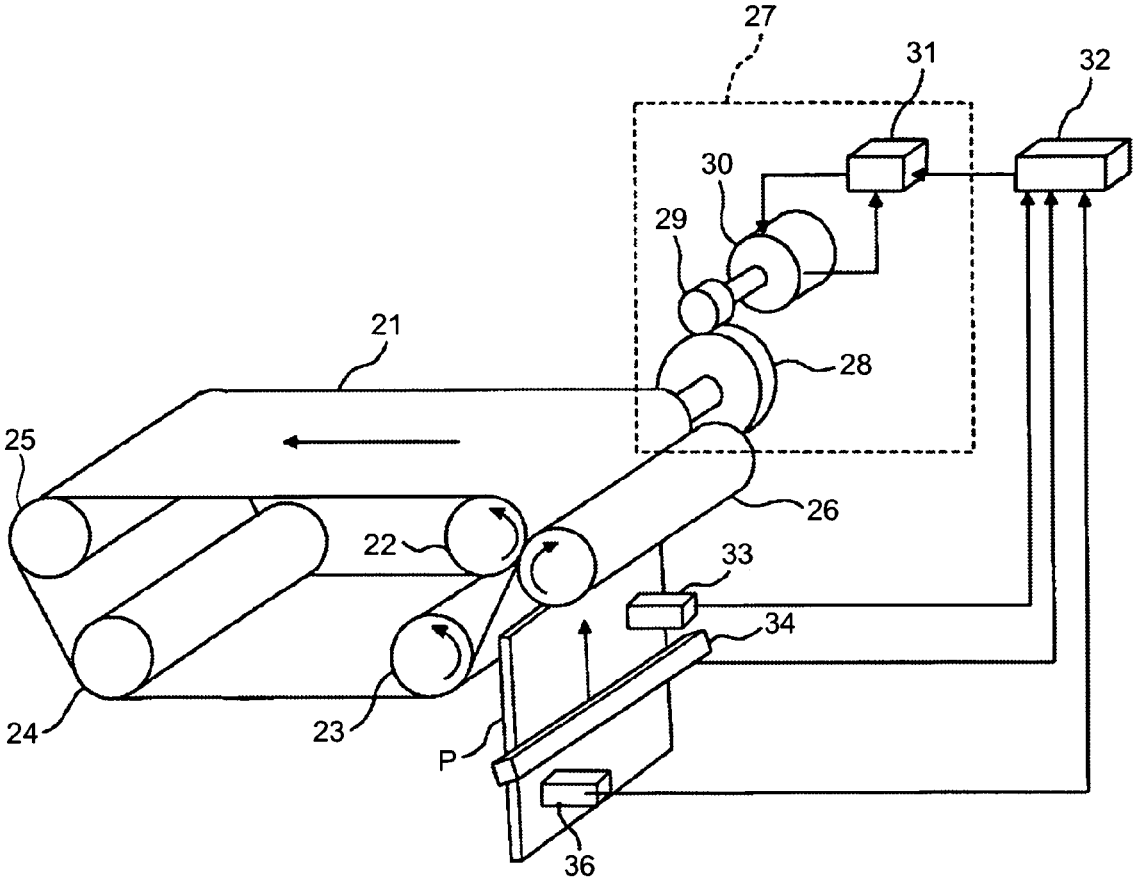
FIG. 16 is a schematic diagram of a sheet conveying device according to a fourth embodiment of the present invention.
Figure 17:
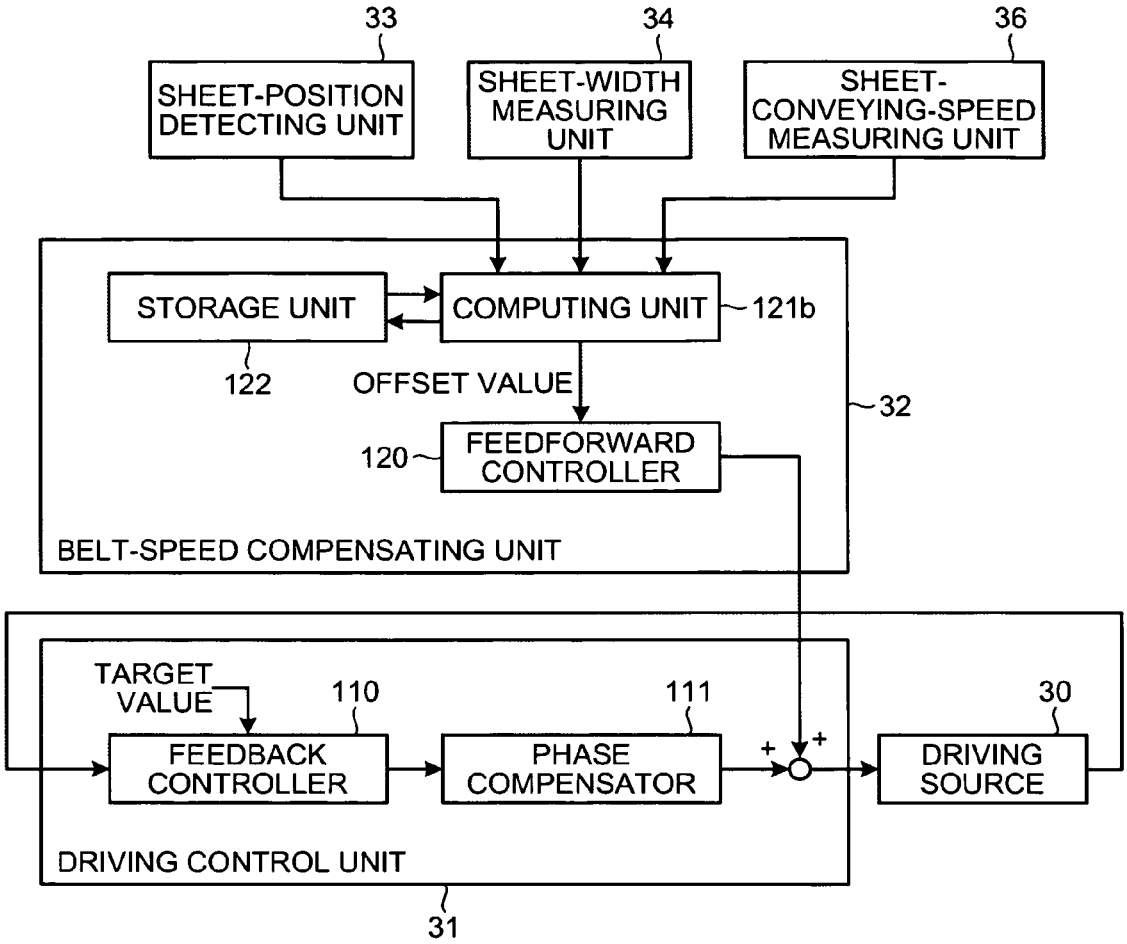
FIG. 17 is a block diagram of a driving control unit and a belt-speed compensating unit shown in FIG. 16.

Although a concept of a sheet conveying device according to a fourth embodiment of the present invention can be implemented with regardless of the presence of an endless belt, it is assumed that the sheet conveying device according to the fourth embodiment includes the endless belt 21. FIG. 16 is a schematic diagram of the sheet conveying device according to the fourth embodiment. FIG. 17 is a block diagram of the driving control unit 31 and the belt-speed compensating unit 32 according to the fourth embodiment. The sheet conveying device according to the fourth embodiment has the structure same as the sheet conveying device according to the second embodiment except that the sheet conveying device according to the fourth embodiment additionally includes a sheet-conveying-speed measuring unit 36 that measures a conveying speed of the sheet P. Parts corresponding to those in the second embodiment are denoted with the same reference numerals, and the same description is not repeated.

The sheet conveying device according to the fourth embodiment performs, in the same manner as the sheet conveying device according to the second embodiment, the feedforward control when the sheet P is fed into the nip between the driving roller 22, the endless belt 21, and the pressure roller 26 to compensate the fluctuation in the rotating speed of the driving roller 22.

Operations of the belt-speed compensating unit 32 are described below. Upon receiving signals from the sheet-width measuring unit 34 and the sheet-conveying-speed measuring unit 36, a computing unit 121*b* either reads the offset value corresponding to the width and the conveying speed of the sheet P from the storage unit 122 or calculates the offset value from the width and the conveying speed of the sheet P. After that, the computing unit 121*b* receives the detection signal from the sheet-position detecting unit 33, and then outputs, when the predetermined time has passed since receiving of the detection signal, the offset value to the feedforward controller 120.

It is expected that even if the sheet thickness is fixed, the fluctuation in the rotating speed of the endless belt 21 occurring when the sheet P is fed into the nip between the driving roller 22, the endless belt 21, and the pressure roller 26 is variable depending on the sheet width and the sheet conveying speed. Therefore, to improve the compensation accuracy in the rotating speed of the endless belt 21 by the feedforward control, it is necessary to adjust the offset value in consideration of both the width and the conveying speed of the sheet P.

The reason why it is necessary to adjust the offset value in consideration of the conveying speed of the sheet P is described below.

Figure 18:
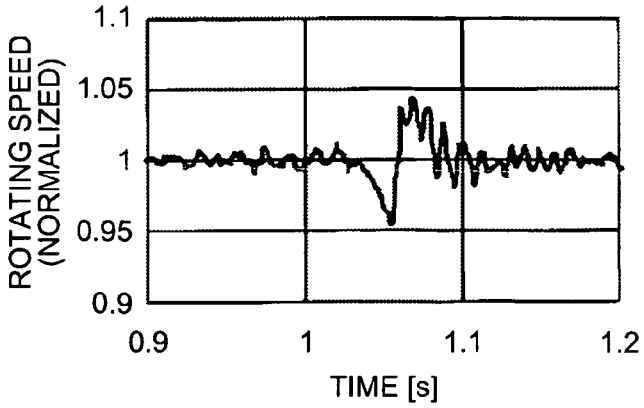
FIG. 18 is a graph of the rotating speed of the driving roller where the sheet is fed at 80 mm/s.
Figure 19:
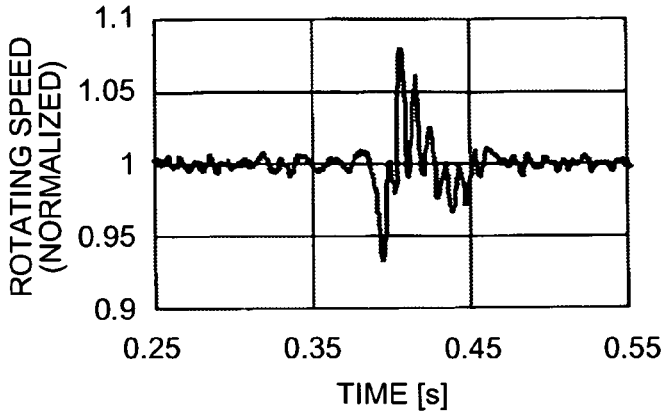
FIG. 19 is a graph of the rotating speed of the driving roller where the sheet is fed at 200 mm/s.

FIGS. 18 and 19 are graph of the rotating speed of the driving roller 22 with the belt-speed compensating unit 32 being OFF. More particularly, the graph shown in FIG. 18 depicts the fluctuation in the rotating speed of the driving roller 22 occurring when the sheet P is fed into the nip between the driving roller 22, the endless belt 21, and the pressure roller 26 at a low conveying speed of 80 mm/s. The graph shown FIG. 19 depicts the fluctuation occurring when the same sheet P, i.e., sheet with the same thickness and the same width, is fed into the nip at a high conveying speed of 200 mm/s.

Figure 20:
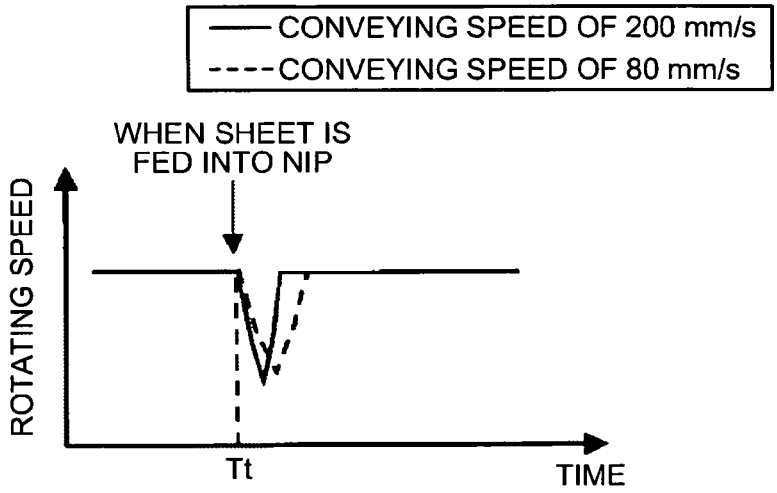
FIG. 20 is a graph depicting the fluctuation in the rotating speed of the driving roller when the sheet is fed at various speeds.

It is clear from FIGS. 18 and 19 that the amount of the fluctuation in the rotating speed of the driving roller 22 depends on the conveying speed of the sheet P. Therefore, it is necessary to adjust the offset value in consideration of the sheet conveying speed. More particularly, as shown in FIG. 20 that is obtained by simplifying the graphs of FIGS. 18 and 19, duration of the fluctuation occurring when the sheet P is fed at 80 mm/s (see a broken line of FIG. 20) is wider than duration of the fluctuation occurring when the sheet P is fed at 200 mm/s (see a full line of FIG. 20). Therefore, because the duration of the fluctuation in the rotating speed of the driving roller 22 depends on the conveying speed of the sheet P, it is necessary to adjust the duration (frequency) of the offset value in consideration of the sheet conveying speed to obtain the correct second drive-command value as output to the driving source 30 for compensating the expected fluctuation.

Figure 21:
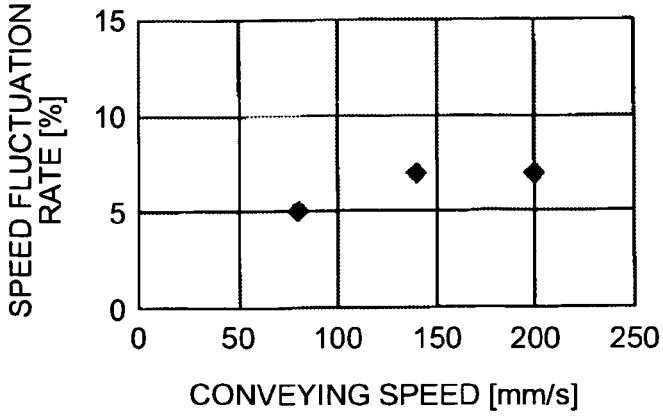
FIG. 21 is a graph of a relation between sheet conveying speed and percentage of the fluctuation in the rotating speed of the driving roller.
Figure 22:
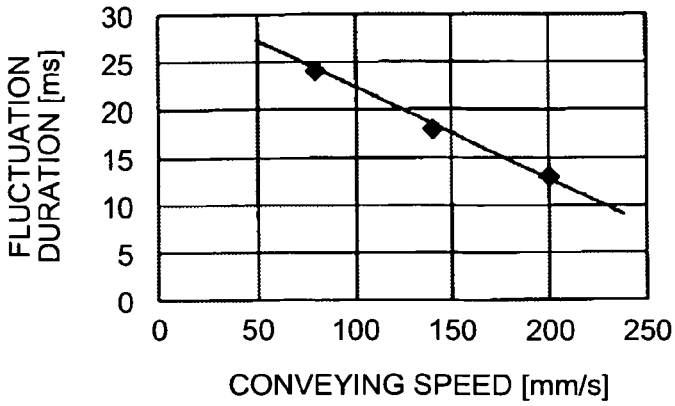
FIG. 22 is a graph of a relation between sheet conveying speed and duration of the fluctuation in the rotating speed of the driving roller.

FIG. 21 is a graph of a relation between conveying speed of the sheet P and percentage of the fluctuation in the rotating speed of the driving roller 22. FIG. 22 is a graph of a relation between conveying speed of the sheet P and duration of the fluctuation in the rotating speed of the driving roller 22. The graphs of FIGS. 21 and 22 are obtained from experiments. As shown in FIG. 21, the rotating speed of the driving roller 22 is substantially independent from the conveying speed of the sheet P. However, as shown in FIG. 22, the duration of the fluctuation is substantially in inverse proportion to the conveying speed of the sheet P.

In other words, in the adjusting of the offset value, the sheet conveying speed affects mainly adjusting of duration of the fluctuation. Meanwhile, the relation between conveying speed of the sheet P and duration of the fluctuation in the rotating speed of the driving roller 22 is not limited to an inverse proportional expression, i.e., the relational expression can be any form.

There are three approaches to adjust the offset value in consideration of both the width and the conveying speed of the sheet P. The first approach is to store in the storage unit 122 various offset values each corresponding to a pattern of the sheet width and the sheet conveying speed. The second approach is to store in the storage unit 122 a relational expression between the sheet width and the fluctuation in the rotating speed of the endless belt 21 and a relational expression between the sheet conveying speed and the fluctuation in the rotating speed of the endless belt 21. The offset value is calculated by using those relational expressions each time when the sheet P is conveyed. The third approach is a combination of the first approach and the second approach.

Assume, for example, that the rotating speed of the endless belt 21 is compensated by using the first approach where the sheet width is categorized into several stages and the sheet conveying speed is also categorized into several stages. Various offset values each corresponding to a pattern of stages of the sheet width and the sheet conveying speed are stored in the storage unit 122. Upon receiving the sheet-width data and the sheet-conveying-speed data from the sheet-width measuring unit 34 and the sheet-conveying-speed measuring unit 36, the computing unit 121*b* selects one from among the various offset values corresponding to the measured width and the measured conveying speed of the sheet P, and outputs the selected offset value.

Assume, for example, that the rotating speed of the endless belt 21 is compensated by using the second approach where two relational expressions are stored in the storage unit 122: the first relational expression of $y_1=f(x_1)$ where $y_1$ is amount of the fluctuation in the rotating speed of the endless belt 21 and $x_1$ is width of the sheet P, and a third relational expression of $y_3=g(x_3)$ where $y_3$ is duration of the fluctuation in the rotating speed of the endless belt 21 and $x_3$ is conveying speed of the sheet P. The first relational expression is obtained from the experimental result shown in FIG. 8; and the third relational expression is obtained from the experimental result shown in FIG. 22. Upon receiving the sheet-width data and the sheet-conveying-speed data from the sheet-width measuring unit 34 and the sheet-conveying-speed measuring unit 36, the computing unit 121*b* calculates the offset value from the measured width and the measured conveying speed of the sheet P, and outputs the calculated offset value.

Assume, for example, that the rotating speed of the endless belt 21 is compensated by using the third approach where various offset values each corresponding to a given sheet conveying speed and the first relational expression are stored in the storage unit 122. Upon receiving the sheet-conveying-speed data from the sheet-conveying-speed measuring unit 36, the computing unit 121*b* reads one from among the various offset values stored in the storage unit 122 corresponding to the measured sheet conveying speed. Upon receiving the sheet-width data from the sheet-width measuring unit 34, the computing unit 121*b* calculates the offset value from the measured width by using the first relational expression. Thus, the belt-speed compensating unit 32 compensates the rotating speed of the endless belt 21 in consideration of both the width and the conveying speed of the sheet P.

The third approach is advantageous in reducing both the necessity minimum capacity of the storage unit and the load on the computing unit, if the third approach is used in such a case where the relation between width of the sheet P and amount of the fluctuation in the rotating speed of the endless belt 21 is simple, e.g., a proportional relation but the relation between conveying speed of the sheet P and duration of the fluctuation in the rotating speed of the endless belt 21 is not simple.

Assume that there are several first relational expressions and a first relational expression to be used is selected depending on the conveying speed of the sheet P. In this case, the computing unit 121*b* has to select a first relational expression to be used from among the several first relational expressions that are stored in the storage unit 122. Therefore, if the computing power of the computing unit 121*b* is not high enough, the first approach is recommended in this case.

Figure 31:
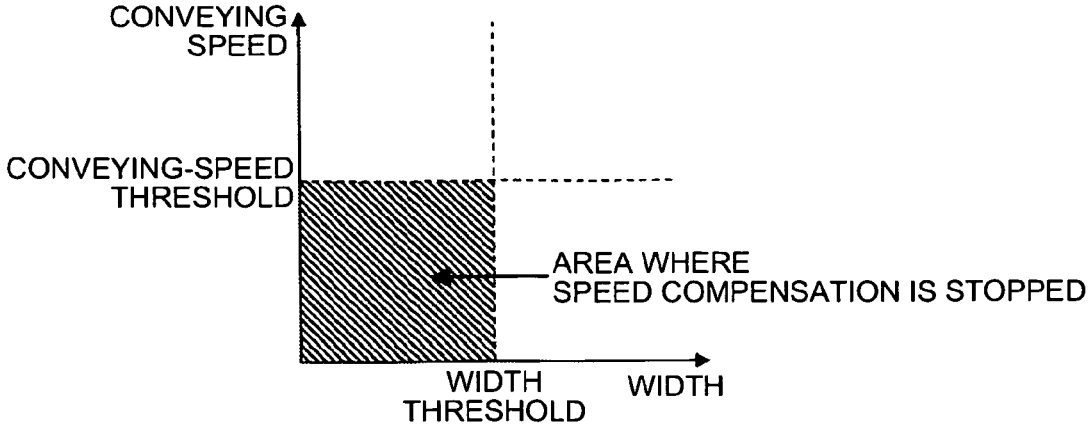
FIG. 31 is a graph depicting an area (width-conveying speed) where performing of the speed compensation is stopped.

In this manner, the sheet conveying device according to the fourth embodiment adjusts the offset value in consideration with both the width and the conveying speed of the sheet P. However, in some cases where the width of the sheet P or the conveying speed of the sheet P is not high enough, it is unnecessary to perform the speed compensation by the feed-forward control according to the fourth embodiment, because the fluctuation in the rotating speed of the endless belt 21 is too small to cause a distortion of the image. More particularly, a predetermined value with regard to the sheet width or a predetermined value with regard to the sheet conveying speed is stored in the storage unit 122 as the width threshold or a conveying-speed threshold. The computing unit 121*b* compares the width of the sheet P measured by the sheet-width measuring unit 34 with the width threshold or the conveying speed of the sheet P measured by the sheet-conveying-speed measuring unit 36 with the conveying-speed threshold. If the measured sheet width is equal to or smaller than the width threshold or the measured sheet conveying speed is equal to or smaller than the conveying-speed threshold, the belt-speed compensating unit 32 stops performing the speed compensation. This configuration is advantageous in reducing the necessity minimum capacity of the storage unit and the load on the computing unit. Alternatively, the belt-speed compensating unit 32 stops performing the speed compensation, if, as shown in FIG. 31, both the measured sheet width and the measured sheet conveying speed are equal to or smaller than the threshold thereof.

Figure 23:
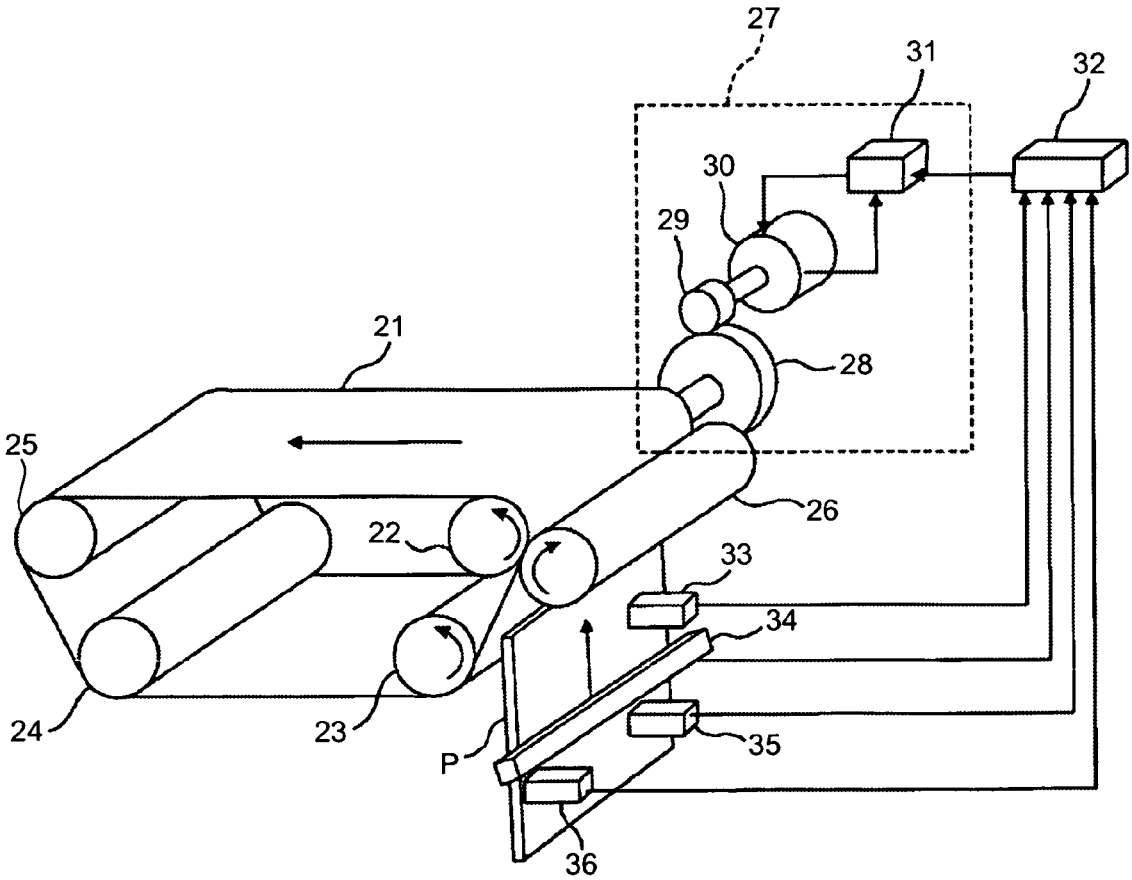
FIG. 23 is a schematic diagram of a sheet conveying device according to a fifth embodiment of the present invention.
Figure 24:
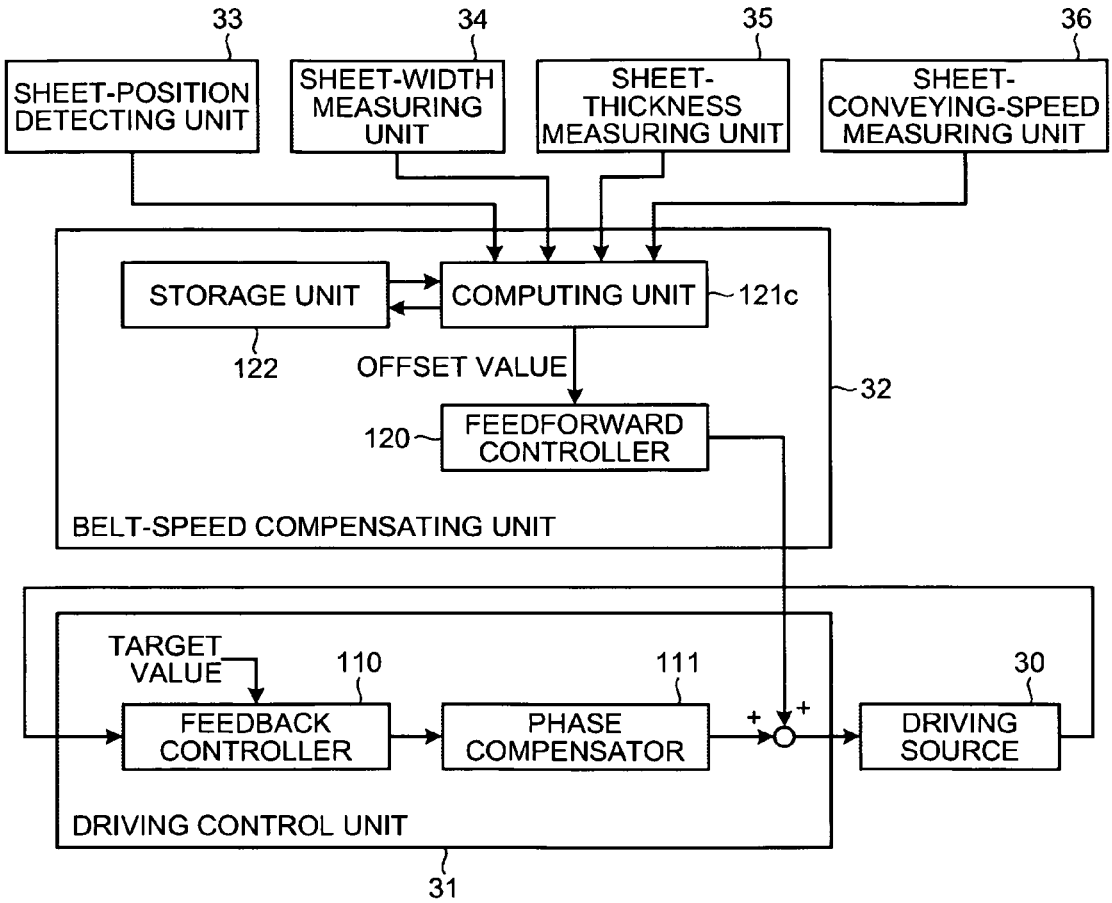
FIG. 24 is a block diagram of a driving control unit and a belt-speed compensating unit shown in FIG. 23.

Although a concept of a sheet conveying device according to a fifth embodiment of the present invention can be implemented with regardless of the presence of an endless belt, it is assumed that the sheet conveying device according to the fifth embodiment includes the endless belt 21. FIG. 23 is a schematic diagram of the sheet conveying device according to the fifth embodiment. FIG. 24 is a block diagram of the driving control unit 31 and the belt-speed compensating unit 32 according to the fifth embodiment. The sheet conveying device according to the fifth embodiment has the structure same as the sheet conveying device according to the third embodiment except that the sheet conveying device according to the fifth embodiment additionally includes the sheet-conveying-speed measuring unit 36 that measures the conveying speed of the sheet P. Parts corresponding to those in the third embodiment are denoted with the same reference numerals, and the same description is not repeated.

The sheet conveying device according to the fifth embodiment performs, in the same manner as the sheet conveying device according to the third embodiment, the feedforward control when the sheet P is fed into the nip between the driving roller 22, the endless belt 21, and the pressure roller 26 to compensate the fluctuation in the rotating speed of the driving roller 22.

Operations of the belt-speed compensating unit 32 are described below. Upon receiving signals from the sheet-width measuring unit 34, the sheet-thickness measuring unit 35, and the sheet-conveying-speed measuring unit 36, a computing unit 121*c* either reads the offset value corresponding to the width, the thickness, and the conveying speed of the sheet P from the storage unit 122 or calculates the offset value from the width, the thickness, and the conveying speed of the sheet P. After that, the computing unit 121*c* receives the detection signal from the sheet-position detecting unit 33, and then outputs, when the predetermined time has passed since receiving of the detection signal, the offset value to the feedforward controller 120.

Upon receiving the offset value from the computing unit 121*c*, the feedforward controller 120 converts the offset value to the second drive-command value, and outputs the second drive-command value to the driving control unit 31. The first drive-command value of the feedback controller 110 and the second drive-command value of the feedforward controller 120 are added in the driving control unit 31, and the added drive-command value is output to the driving source 30.

It is expected that the fluctuation in the rotating speed of the endless belt 21 occurring when the sheet P is fed into the nip between the driving roller 22, the endless belt 21, and the pressure roller 26 depends on the width, the thickness, and the conveying speed of the sheet P. Therefore, to improve the compensation accuracy in the rotating speed of the endless belt 21 by the feedforward control, it is necessary to adjust the offset value in consideration of all the width, the thickness, and the conveying speed of the sheet P. The reasons why the width, the thickness, and the conveying speed are to be considered have already been described with reference to FIGS. 5 to 8, FIGS. 12 to 15, and FIGS. 18 to 22. Therefore, the same description is not repeated.

There are three approaches, as compared to the three approaches described in the third embodiment, to adjust the offset value in consideration of all the width, the thickness, and the conveying speed of the sheet P. The first approach is to categorize each of the sheet width, the sheet thickness, and the sheet conveying speed into several stages, and store in the storage unit 122 various offset values corresponding to all patterns of the stages of the sheet width, the sheet thickness, and the sheet conveying speed. The second approach is to store in the storage unit 122 a relational expression between the sheet width and the fluctuation in the rotating speed of the endless belt 21, a relational expression between the sheet thickness and the fluctuation in the rotating speed of the endless belt 21, and a relational expression between the sheet conveying speed and the fluctuation in the rotating speed of the endless belt 21. The third approach is a combination of the first approach and the second approach.

In this manner, even if the sheet width, the sheet thickness, and the sheet conveying speed are not fixed, the sheet conveying device according to the fifth embodiment can compensate the fluctuation in the rotating speed of the endless belt accurately, thereby remarkably suppressing a distortion of the image due to the fluctuation.

The sheet conveying device, as described above, adjusts the offset value in consideration with all the width, the thickness, and the conveying speed of the sheet P. However, in some cases where at least one of the width, the thickness, and the conveying speed of the sheet P is not high enough, it is unnecessary to perform the speed compensation by the feedforward control according to the fifth embodiment, because the fluctuation in the rotating speed of the endless belt 21 is too small to cause a distortion of the image. More particularly, the operator decides the width threshold, the thickness threshold, and the conveying-speed threshold, and stores those thresholds in the storage unit 122. The computing unit 121*c* compares the width of the sheet P measured by the sheet-width measuring unit 34 with the width threshold, the thickness of the sheet P measured by the sheet-thickness measuring unit 35 with the thickness threshold, and the conveying speed of the sheet P measured by the sheet-conveying-speed measuring unit 36 with the conveying-speed threshold. If at least one of the measured sheet width, the measured sheet thickness, and the measured sheet conveying speed are equal to or smaller than the threshold thereof, the belt-speed compensating unit 32 stops performing the speed compensation. This configuration is advantageous in reducing the necessity minimum capacity of the storage unit and the load on the computing unit.

Alternatively, the belt-speed compensating unit 32 stops performing the speed compensation, if two of the measured sheet width, the measured sheet thickness, and the measured sheet conveying speed are equal to or smaller than the threshold thereof. That is, the belt-speed compensating unit 32 stops performing the speed compensation in following three cases: the first case shown in FIG. 30 where both the width and the thickness are equal to or smaller than the threshold thereof, the second case shown in FIG. 31 where both the width and the conveying speed are equal to or smaller than the threshold thereof, and the third case shown in FIG. 32 where both the thickness and the conveying speed are equal to or smaller than the threshold thereof. Still alternatively, the belt-speed compensating unit 32 stops performing the speed compensation, if all the measured sheet width, the measured sheet thickness, and the measured sheet conveying speed are equal to or smaller than the threshold thereof.

Figure 25:
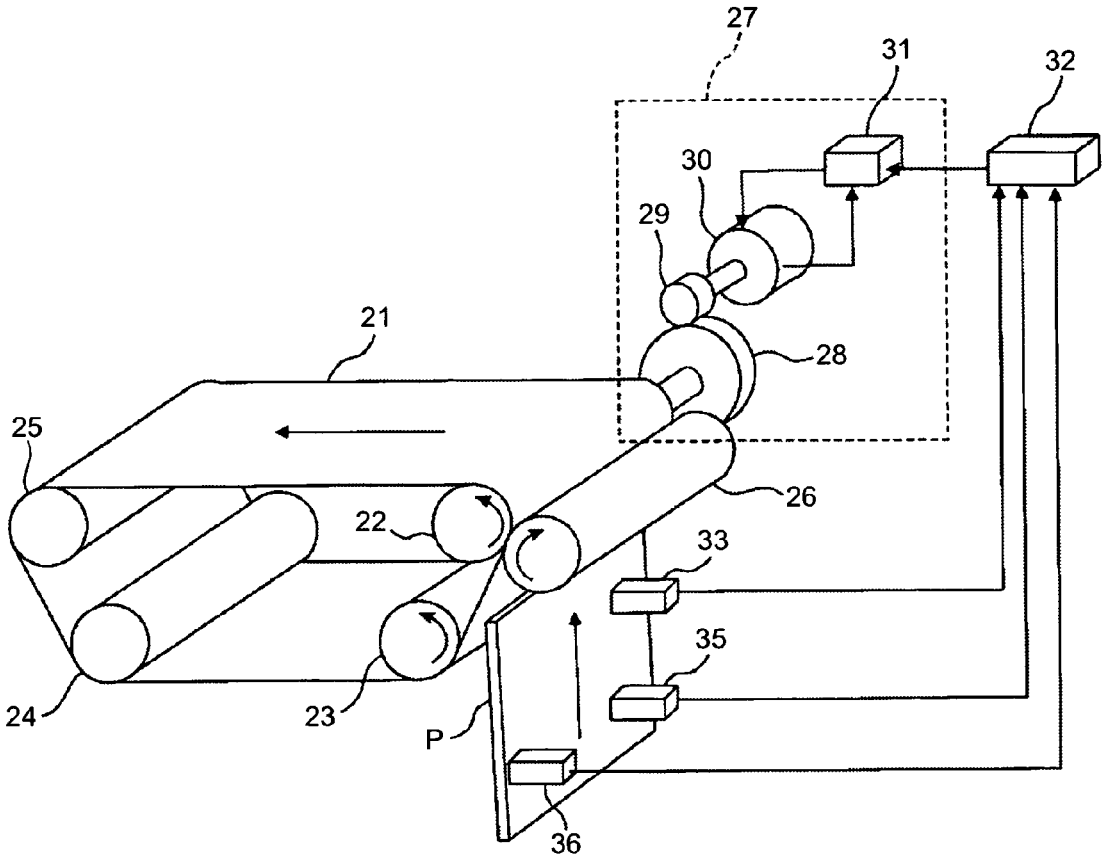
FIG. 25 is a schematic diagram of a sheet conveying device according to a sixth embodiment of the present invention.
Figure 26:
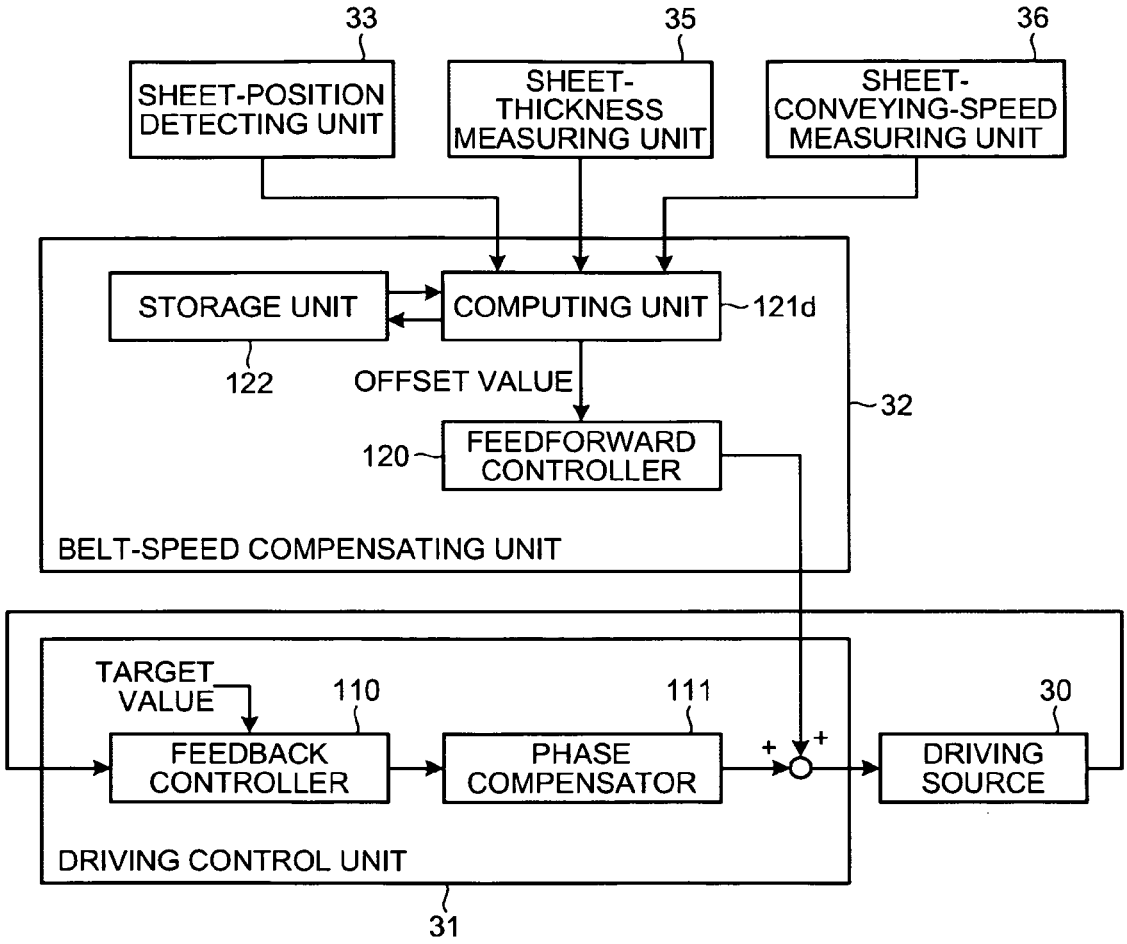
FIG. 26 is a block diagram of a driving control unit and a belt-speed compensating unit shown in FIG. 25.

Although a concept of a sheet conveying device according to a sixth embodiment of the present invention can be implemented with regardless of the presence of an endless belt, it is assumed that the sheet conveying device according to the sixth embodiment includes the endless belt 21. FIG. 25 is a schematic diagram of the sheet conveying device according to the sixth embodiment. FIG. 26 is a block diagram of the driving control unit 31 and the belt-speed compensating unit 32 according to the sixth embodiment. The sheet conveying device according to the sixth embodiment has the structure same as the sheet conveying device according to the fifth embodiment except that the sheet conveying device according to the sixth embodiment excludes the sheet-width measuring unit 34 that measures the width of the sheet P. Parts corresponding to those in the fifth embodiment are denoted with the same reference numerals, and the same description is not repeated.

The sheet conveying device according to the sixth embodiment performs, in the same manner as the sheet conveying device according to the fifth embodiment, the feedforward control when the sheet P is fed into the nip between the driving roller 22, the endless belt 21, and the pressure roller 26 to compensate the fluctuation in the rotating speed of the driving roller 22.

Operations of the belt-speed compensating unit 32 are described below. Upon receiving signals from the sheet-thickness measuring unit 35 and the sheet-conveying-speed measuring unit 36, a computing unit 121*d* either reads the offset value corresponding to the thickness and the conveying speed of the sheet P from the storage unit 122 or calculates the offset value from the thickness and the conveying speed of the sheet P. After that, the computing unit 121*d* receives the detection signal from the sheet-position detecting unit 33, and then outputs, when the predetermined time has passed since receiving of the detection signal, the offset value to the feed-forward controller 120.

Upon receiving the offset value from the computing unit 121*d*, the feedforward controller 120 converts the offset value to the second drive-command value, and outputs the second drive-command value to the driving control unit 31. The first drive-command value of the feedback controller 110 and the second drive-command value of the feedforward controller 120 are added in the driving control unit 31, and the added drive-command value is output to the driving source 30.

It is expected that even if the sheet width is fixed, the fluctuation in the rotating speed of the endless belt 21 occurring when the sheet P is fed into the nip between the driving roller 22, the endless belt 21, and the pressure roller 26 is variable depending on the thickness and the conveying speed of the sheet P. Therefore, to improve the compensation accuracy in the rotating speed of the endless belt 21 by the feed-forward control, it is necessary to adjust the offset value in consideration of both the thickness and the conveying speed of the sheet P. The reasons why the thickness and the conveying speed are to be considered have already been described with reference to FIGS. 12 to 15 and FIGS. 18 to 22. Therefore, the same description is not repeated.

There are two approaches to adjust the offset value in consideration of both the thickness and the conveying speed of the sheet P. The first approach is to store in the storage unit 122 various offset values each corresponding to a pattern of the sheet thickness and the sheet conveying speed. The second approach is to store in the storage unit 122 a relational expression between the sheet thickness and the fluctuation in the rotating speed of the endless belt 21 and a relational expression between the sheet conveying speed and the fluctuation in the rotating speed of the endless belt 21. The offset value is calculated by using those relational expressions each time when the sheet P is conveyed.

Assume, for example, that the rotating speed of the endless belt 21 is compensated by using the first approach where the sheet thickness is categorized into several stages and the sheet conveying speed is also categorized into several stages. Various offset values each corresponding to a pattern of stages of the sheet thickness and the sheet conveying speed are stored in the storage unit 122. Upon receiving the sheet-thickness data and the sheet-conveying-speed data from the sheet-thickness measuring unit 35 and the sheet-conveying-speed measuring unit 36, the computing unit 121*d* selects one from among the various offset values corresponding to the measured thickness and the measured conveying speed of the sheet P, and outputs the selected offset value.

Assume, for example, that the rotating speed of the endless belt 21 is compensated by using the second approach where two relational expressions are stored in the storage unit 122: the second relational expression of $y_2=f(x_2)$ where $y_2$ is amount of the fluctuation in the rotating speed of the endless belt 21 and $x_2$ is thickness of the sheet P, and the third relational expression of $y_3=g(x_3)$ where $y_3$ is duration of the fluctuation in the rotating speed of the endless belt 21 and $x_3$ is conveying speed of the sheet P. The second relational expression is obtained from the experimental result shown in FIG. 15; and the third relational expression is obtained from the experimental result shown in FIG. 22. Upon receiving the sheet-thickness data and the sheet-conveying-speed data from the sheet-thickness measuring unit 35 and the sheet-conveying-speed measuring unit 36, the computing unit 121*d* calculates the offset value from the measured thickness and the measured conveying speed of the sheet P, and outputs the calculated offset value.

Figure 32:
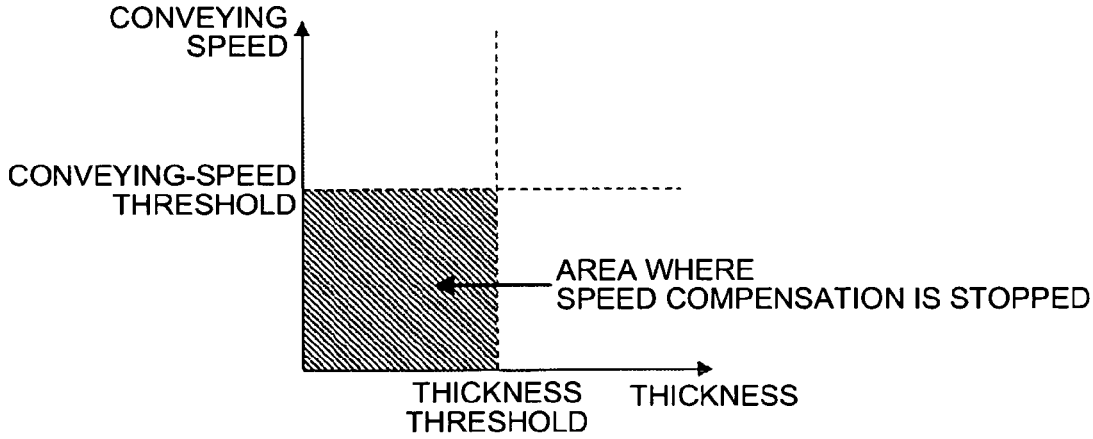
FIG. 32 is a graph depicting an area (conveying speed-thickness) where performing of the speed compensation is stopped.
Figure 33:
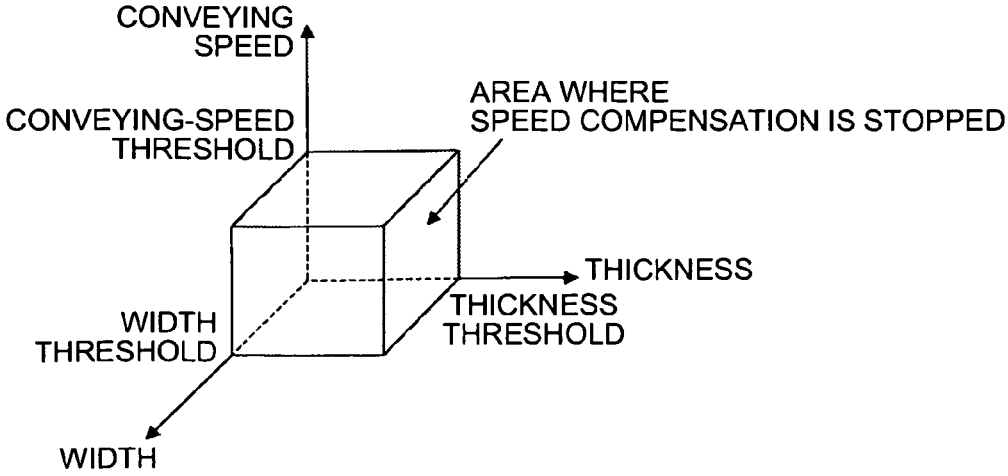
FIG. 33 is a graph depicting an area (width-thickness-conveying speed) where performing of the speed compensation is stopped.

In this manner, the sheet conveying device according to the sixth embodiment adjusts the offset value in consideration with both the thickness and the conveying speed of the sheet P. However, in some cases where the thickness of the sheet P or the conveying speed of the sheet P is not high enough, it is unnecessary to perform the speed compensation by the feed-forward control according to the sixth embodiment, because the fluctuation in the rotating speed of the endless belt 21 is too small to cause a distortion of the image. More particularly, a predetermined value with regard to the sheet thickness or a predetermined value with regard to the sheet conveying speed is stored in the storage unit 122 as the thickness threshold or the conveying-speed threshold. The computing unit 121*d* compares the thickness of the sheet P measured by the sheet-thickness measuring unit 35 with the thickness threshold or the conveying speed of the sheet P measured by the sheet-conveying-speed measuring unit 36 with the conveying-speed threshold. If the measured sheet thickness is equal to or smaller than the thickness threshold or the measured sheet conveying speed is equal to or smaller than the conveying-speed threshold, the belt-speed compensating unit 32 stops performing the speed compensation. This configuration is advantageous in reducing the necessity minimum capacity of the storage unit and the load on the computing unit. Alternatively, the belt-speed compensating unit 32 stops performing the speed compensation, if, as shown in FIG. 32, both the measured sheet thickness and the measured sheet conveying speed are equal to or smaller than the threshold thereof.

Figure 27:
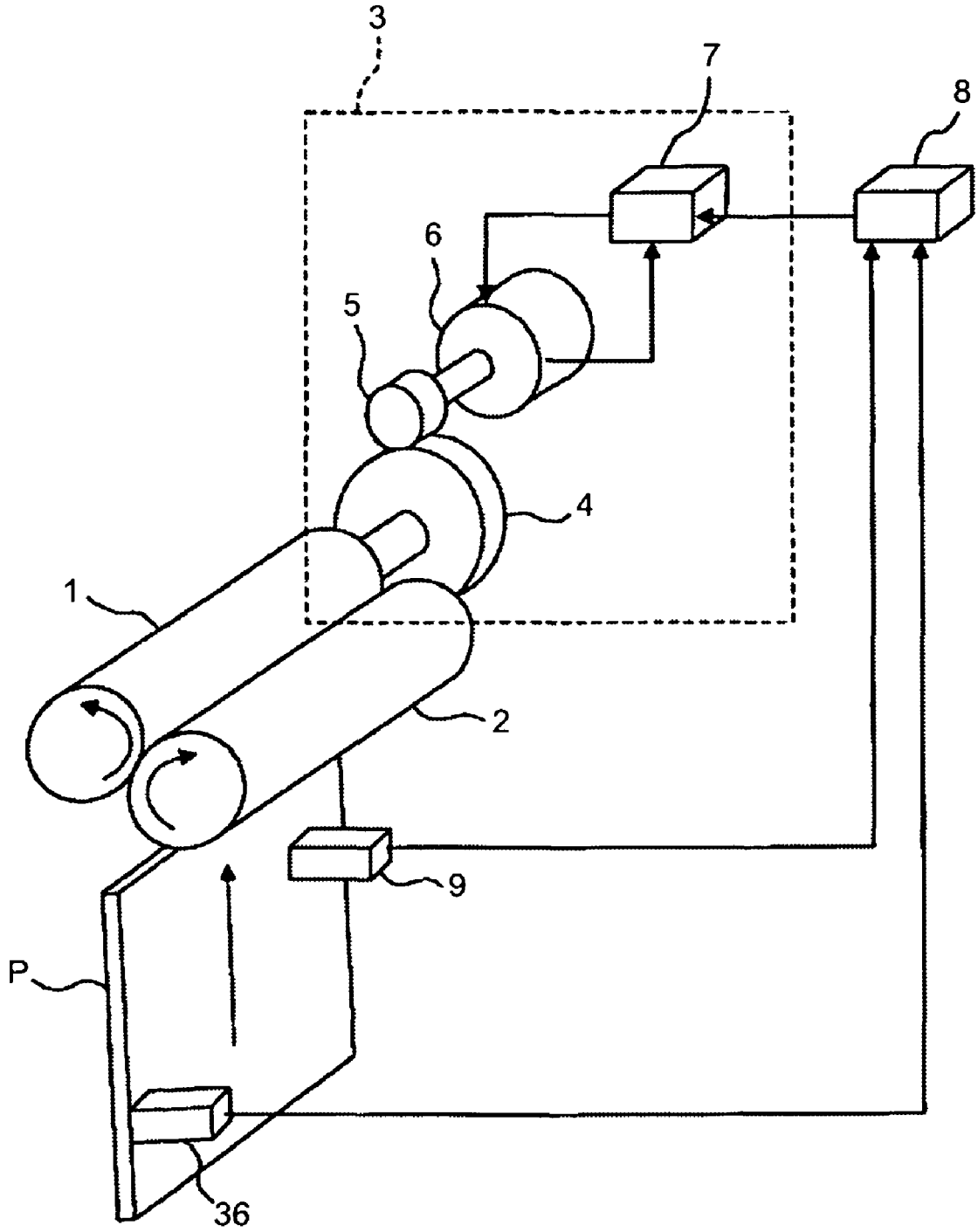
FIG. 27 is a schematic diagram of a sheet conveying device according to a seventh embodiment of the present invention.
Figure 28:
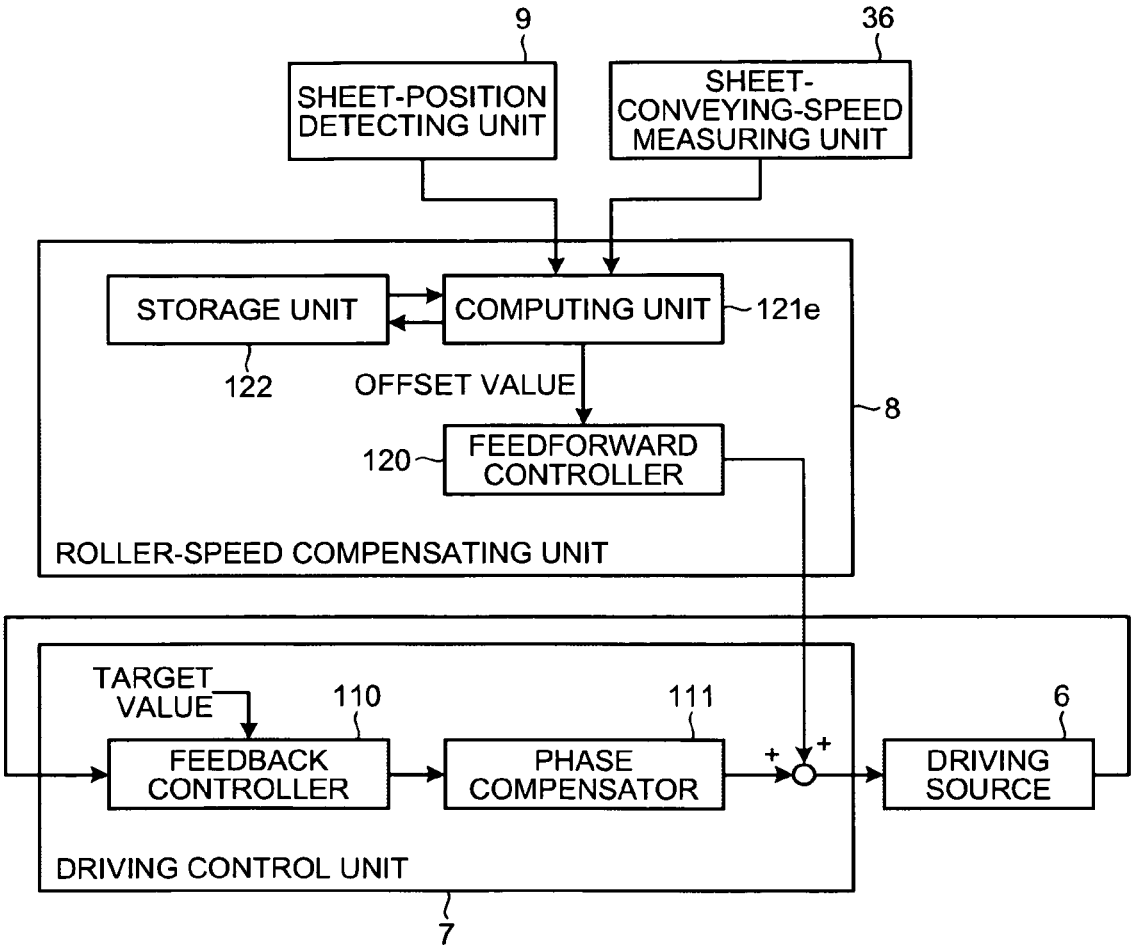
FIG. 28 is a block diagram of a driving control unit and a roller-speed compensating unit shown in FIG. 27.

FIG. 27 is a schematic diagram of a sheet conveying device according to a seventh embodiment of the present invention. FIG. 28 is a block diagram of the driving control unit 7 and the roller-speed compensating unit 8 according to the seventh embodiment. The sheet conveying device according to the seventh embodiment has the structure same as the sheet conveying device according to the first embodiment except that the sheet conveying device according to the seventh embodiment excludes the sheet-width measuring unit 10 and additionally includes the sheet-conveying-speed measuring unit 36. Parts corresponding to those in the first embodiment are denoted with the same reference numerals, and the same description is not repeated.

Operations of the roller-speed compensating unit 8 are described with reference to FIG. 28. Upon receiving the sheet-conveying-speed data from the sheet-conveying-speed measuring unit 36, a computing unit 121*e* either reads an offset value corresponding to the conveying speed of the sheet P from the storage unit 122 or calculates the offset value from the conveying speed of the sheet P. After that, the computing unit 121*e* receives the detection signal from the sheet-position detecting unit 9, and outputs, when the predetermined time has passed since receiving of the detection signal, the offset value to the feedforward controller 120 so that timing of the feedforward control is matched with timing at which the sheet P is fed into the nip.

Upon receiving the offset value from the computing unit 121*e*, the feedforward controller 120 converts the offset value to the second drive-command value, and outputs the second drive-command value to the driving control unit 7. The first drive-command value of the feedback controller 110 and the second drive-command value of the feedforward controller 120 are added in the driving control unit 7, and the added drive-command value is output to the driving source 6.

Figure 4:
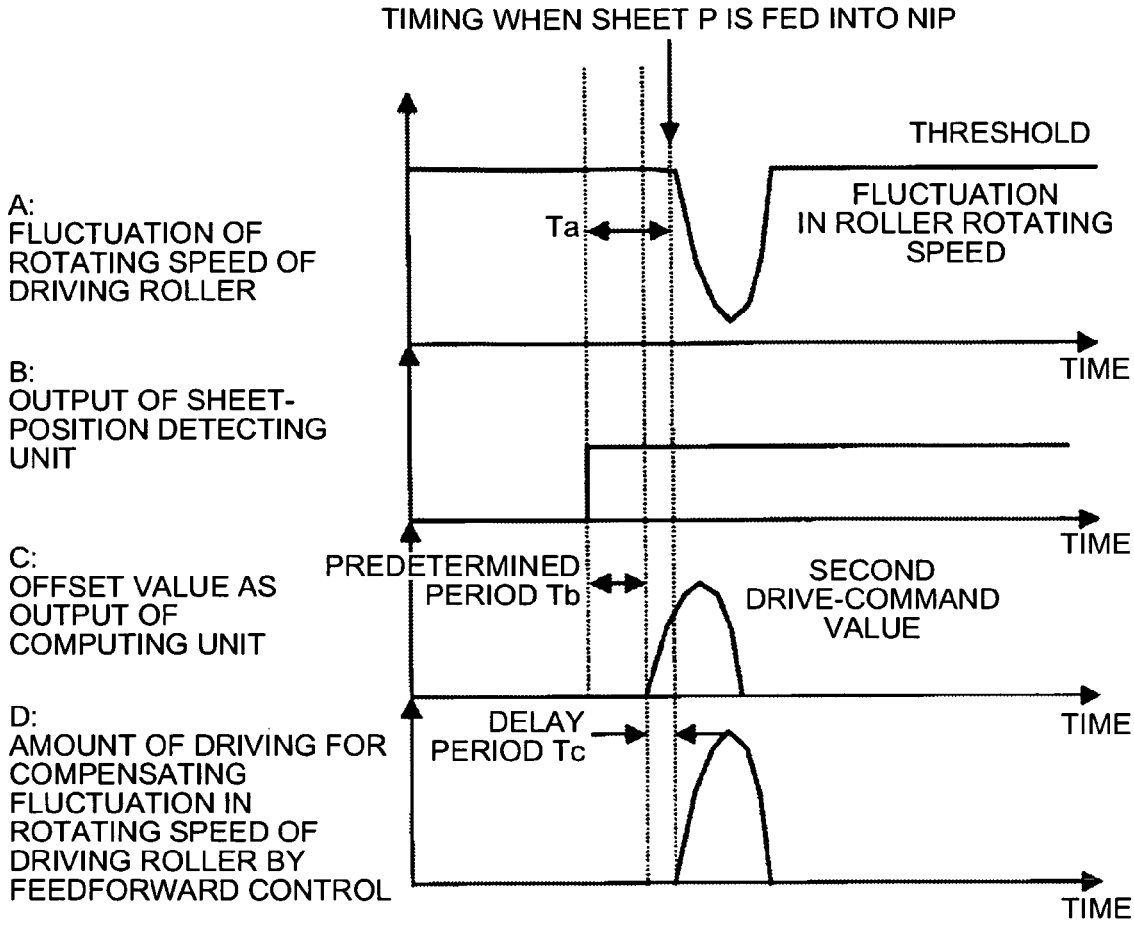
FIG. 4 is a timing chart for explaining the feedforward control.

Operations of the feedforward control are same as the operations described in the first embodiment with reference to FIG. 4, and therefore the same description is not repeated.

Even if the sheet width and the sheet thickness are fixed, the fluctuation in the rotating speed of the driving roller 1 occurring when the sheet P is fed into the nip between the driving roller 1 and the pressure roller 2 is variable depending on the sheet conveying speed. Therefore, to improve the compensation accuracy in the rotating speed of the driving roller 1 by the feedforward control, it is necessary to adjust the offset value in consideration of the conveying speed of the sheet P. The reason why the conveying speed is to be considered has already been described with reference to FIGS. 18 to 22, and the same description is not repeated.

In this manner, the roller-speed compensating unit 8 adjusts the offset value in consideration of the conveying speed of the sheet P that is measured by the sheet-conveying-speed measuring unit 36. Meanwhile, the sheet-conveying-speed measuring unit 36 can be any type of speed measuring unit that has been widely known.

There are two approaches to adjust the offset value in consideration of the conveying speed of the sheet P. The first approach is to store in the storage unit 122 various offset values each corresponding to a given sheet conveying speed. Upon receiving the sheet-conveying-speed data of the sheet P from the sheet-conveying-speed measuring unit 36, the computing unit 121*e* selects one from among the various offset values stored in the storage unit 122 corresponding to the measured sheet conveying speed, and outputs the selected offset value to the feedforward controller 120. The second approach is to store in the storage unit 122 a reference offset value corresponding to a reference sheet conveying speed and a relational expression $y_3=g(x_3)$ where $y_3$ is duration of the fluctuation in the rotating speed of the driving roller 1 and $x_3$ is conveying speed of the sheet P. Meanwhile, the relational expression is obtained from the experimental result shown in FIG. 22. Upon receiving the sheet-conveying-speed data of the sheet P from the sheet-conveying-speed measuring unit 36, the roller-speed compensating unit 8 calculates the proper offset value from the sheet-conveying-speed data and the relational expression, and outputs the calculated offset value to the feedforward controller 120. The first approach can be implemented with a relatively simple software program because no computing process is required. The second approach is advantageous in remarkably reducing the necessity minimum capacity of the storage unit.

In this manner, the sheet conveying device according to the seventh embodiment measures the conveying speed of the sheet P and uses the proper offset value corresponding to the measured sheet conveying speed. Therefore, even if the conveying speed of the sheet P is not fixed, the fluctuation in the rotating speed of the driving roller 1 is compensated correctly by the feedforward control.

In some cases where the conveying speed of the sheet P is not high enough, it is unnecessary to perform the speed compensation by the feedforward control according to the seventh embodiment, because the fluctuation in the rotating speed of the driving roller 1 is too small to cause a distortion of the image. More particularly, a predetermined value with regard to the sheet conveying speed is stored in the storage unit 122 as the conveying-speed threshold. The computing unit 121*e* compares the conveying speed of the sheet P measured by the sheet-conveying-speed measuring unit 36 with the conveying-speed threshold. The roller-speed compensating unit 8 stops performing the speed compensation, if the measured sheet conveying speed is equal to or higher than the conveying-speed threshold. This configuration is advantageous in reducing the necessity minimum capacity of the storage unit and the load on the computing unit.

Figure 29:
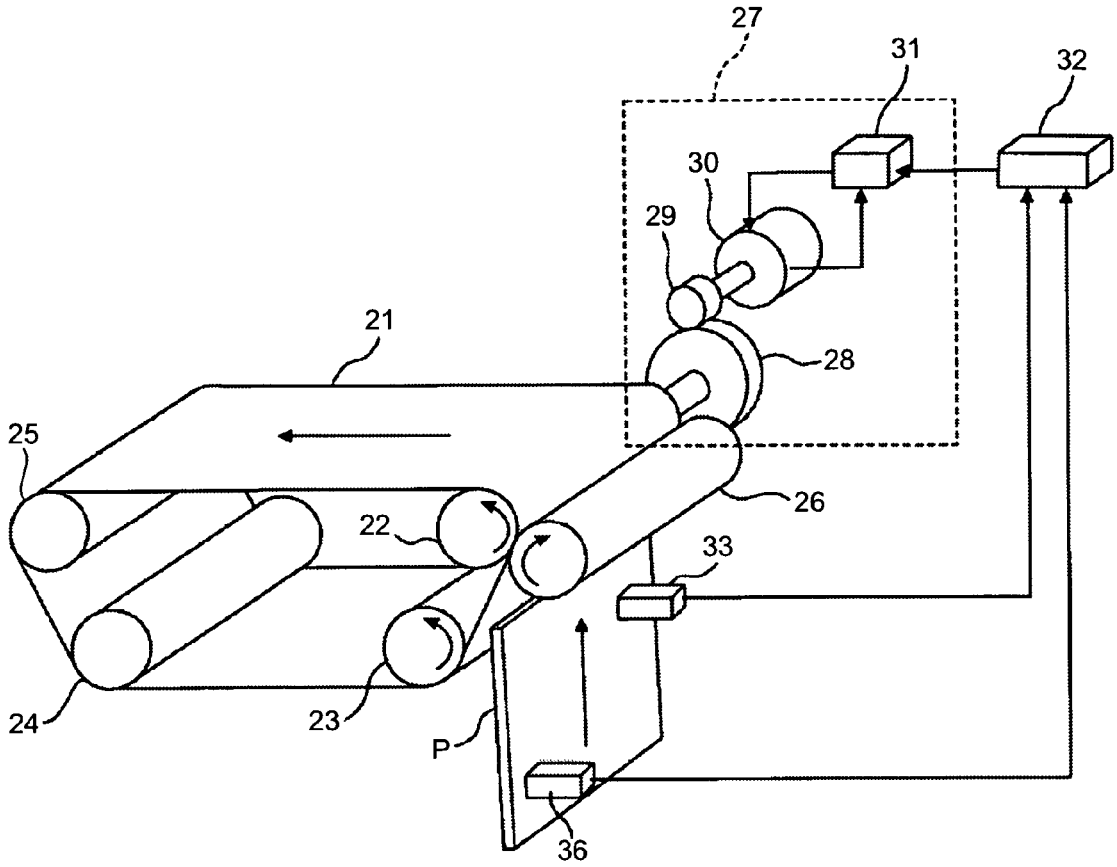
FIG. 29 is a schematic diagram of a sheet conveying device according to an eighth embodiment of the present invention.

FIG. 29 is a schematic diagram of a sheet conveying device according to an eighth embodiment of the present invention. The sheet conveying device according to the eighth embodiment has the structure same as the sheet conveying device according to the second embodiment except that the sheet conveying device according to the eighth embodiment excludes the sheet-width measuring unit 34 and additionally includes the sheet-conveying-speed measuring unit 36. Parts corresponding to those in the second embodiment are denoted with the same reference numerals, and the same description is not repeated.

Operations of the belt-speed compensating unit 32 are same as the operations of the roller-speed compensating unit 8 according to the seventh embodiment. A method of adjusting the offset value in consideration of the conveying speed of sheet P is same as the method described in the seventh embodiment. Therefore, the same descriptions are not repeated.

Moreover, a method of stop performing the speed compensation by the feedforward control if the conveying speed of the sheet P is equal to or smaller than the conveying-speed threshold is same as the method described in the seventh embodiment, and the same description is not repeated.

Although the sheet conveying device according to any one of the embodiments can be used in any device that needs to convey a sheet, the sheet conveying device is especially useful in an electrophotographic image forming apparatus. In such an electrophotographic image forming apparatus, the sheet conveying device is used as a part of various devices such as the intermediate transfer device, the fixing device, and the transfer fixing device. The sheet conveying device can be used in various types of image forming apparatuses. Assume now that the sheet conveying device is used in a tandem-type image forming apparatus using the intermediate transfer system.

Figure 34:
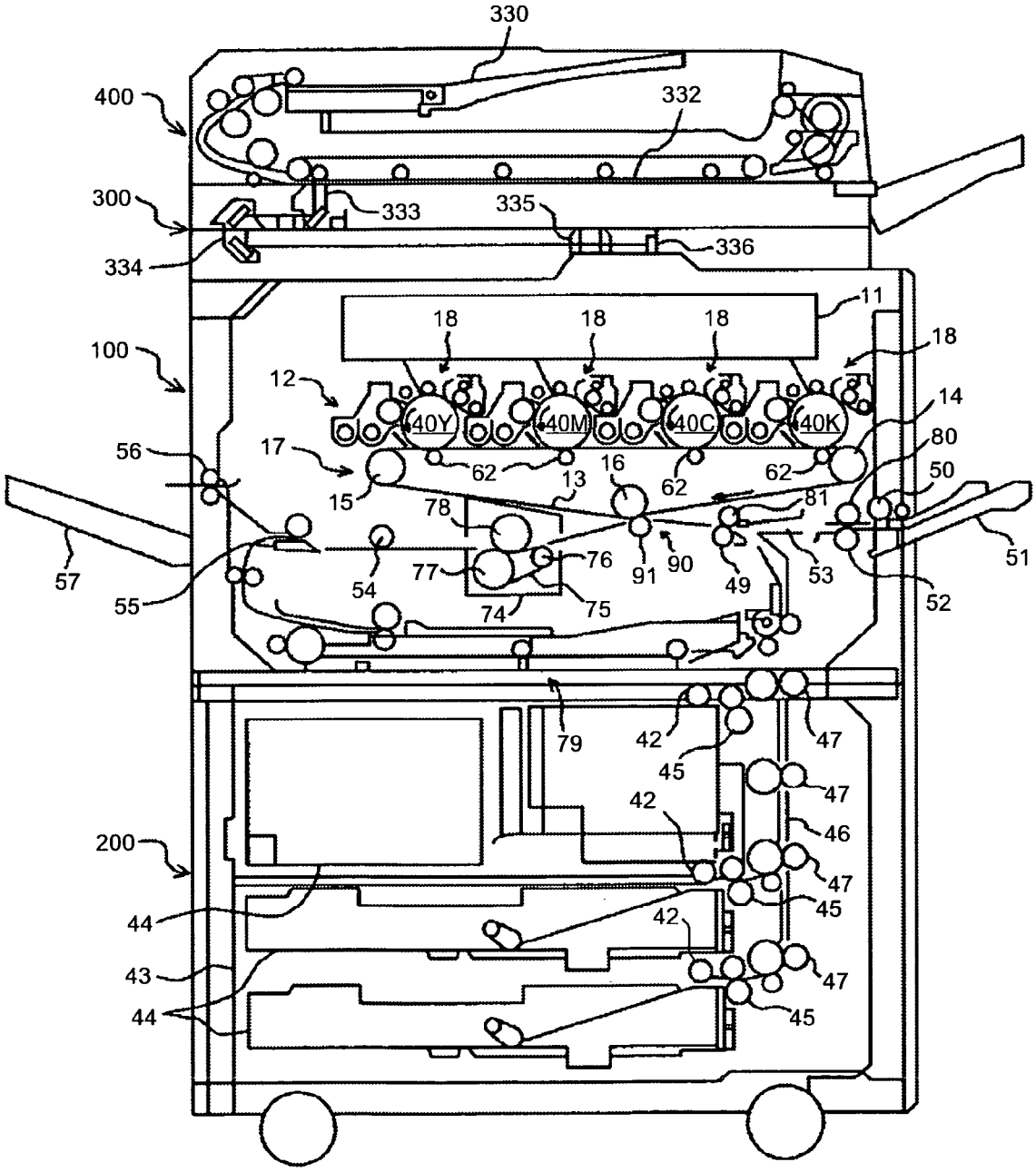
FIG. 34 is a schematic diagram of an image forming apparatus according to a ninth embodiment of the present invention.

FIG. 34 is a schematic diagram of a copier as the tandem-type image forming apparatus according to a ninth embodiment of the present invention. The copier includes a main body 100, a paper-feed table 200 on which the main body 100 is placed, a scanner 300 that is placed on a top surface of the main body 100, and an automatic document feeder (ADF) 400 that is placed on a top surface of the scanner 300.

An endless intermediate transfer belt 13 is arranged near the center of the main body 100 as the intermediate transfer medium. The intermediate transfer belt 13 is placed over three support rollers 14, 15, and 16, and is rotated clockwise.

The support roller 16 works as a driving roller that rotates the intermediate transfer belt 13. The support roller 15 works as a tension roller that keeps tension of the intermediate transfer belt 13 constant. By exertion of an elastic member (not shown) such as a spring, the support roller 15 comes in contact with an inner surface of the intermediate transfer belt 13, pressing the intermediate transfer belt 13 outward.

An intermediate-transfer-belt cleaning device 17 is arranged on an outer surface of the intermediate transfer belt 13 near the support roller 15 (left side of FIG. 34). The intermediate-transfer-belt cleaning device 17 removes residual toner from the outer surface of the intermediate transfer belt 13 after the image is transferred.

Four image forming units 18 for yellow (Y), magenta (M), cyan (C), and black (K) are arranged on an upside of the intermediate transfer belt 13 in this order with the image forming unit 18 for yellow being most-upstream with respect to the rotating direction of the intermediate transfer belt 13. The four image forming units 18 form a tandem-type image forming device 12 as a unit. An exposure 11 is arranged above the tandem-type image forming device 12.

It is allowable to use a drum instead of a belt as the intermediate transfer medium. If the intermediate transfer medium is a drum, the intermediate transfer belt 13 and the support rollers 14 and 15 are unnecessary and the image forming units 18 are arranged not in a line but around a circumference of the intermediate transfer drum. The sheet conveying device according to any one of the embodiments can be used as a part of the intermediate transfer device with regardless of the type of intermediate transfer device such as the belt or the drum.

A secondary transfer device 90 is arranged on a downside of the intermediate transfer belt 13. In the secondary transfer device 90, a secondary transfer roller 91 presses the intermediate transfer belt 13 against the support roller 16, so that the image is transferred from the intermediate transfer belt 13 onto the sheet P. The sheet P with the image is conveyed to a fixing device 74. It is noted that the secondary transfer device 90 has a function of conveying, after the image is transferred from the intermediate transfer belt 13 onto the sheet P, the sheet P to the fixing device 74. The fixing device 74 that fixes the image on the sheet P is arranged downstream of the secondary transfer device 90.

The fixing device 74 includes a heat roller 76, a fixing roller 77, a fixing belt 75 over the heat roller 76 and the fixing roller 77, and a pressure roller 78. The pressure roller 78 forms with the heat roller 76 a nip between which the fixing belt 75 is placed. The heat roller 76 works as a tension roller that keeps tension of the fixing belt 75 constant. By exertion of an elastic member (not shown) such as a spring, the heat roller 76 comes in contact with an inner surface of the fixing belt 75, pressing the fixing belt 75 outward. The fixing belt 75 is heated by the heat roller 76 enough for the image fixing. The fixing device 74 fixes the image onto the sheet P by the heat and pressure.

Although the above-described fixing device is a belt-type fixing device, it is allowable to use a roller-type fixing device including the heat roller 76 and the fixing roller 77.

The copier according to the ninth embodiment includes a sheet reversing device 79 located on a level, below the secondary transfer device 90 and the fixing device 74, parallel to a level on which the tandem-type image forming device 12 is located. The sheet reversing device 79 reverses the sheet P with a first image on a front surface so that a second image can be formed onto a back surface of the sheet P.

When a user tries to copy an original, the user places the original on a document tray 330 of the ADF 400. Alternatively, the user opens the ADF 400, places the original on an exposure glass 332 of the scanner 300, and then closes and presses the ADF 400. When the user presses a start button (not shown), the original, if it is placed on the ADF 400, is moved onto the exposure glass 332. On the other hand, if the original is placed on the exposure glass 332, the scanner 300 operates immediately. A first carrier 333 and a second carrier 334 are moved. A light source on the first carrier 333 emits a light to the original. A mirror on the second carrier 334 receives the light reflected from the original, and then reflects the light to a scanning sensor 336. The scanning sensor 336 receives the light via a focusing lens 335, thereby reading contents of the original.

In parallel with the original scanning, a driving motor (not shown) rotates the support roller 16, thereby rotating the other support rollers 14 and 15 and the intermediate transfer belt 13. Four photosensitive elements 40 (40Y, 40M, 40C, 40K) of the image forming units 18 are rotated at the same timing. Each of the four photosensitive elements 40Y, 40M, 40C, and 40K is exposed with a light that is modulated based on the corresponding single-color data. As a result, four single-toner images are developed on the four photosensitive elements 40. The single-toner images are then sequentially transferred onto the rotating intermediate transfer belt 13, and thus a full-color image is formed on the intermediate transfer belt 13.

In parallel with the image forming, one of paper-feed rollers 42 of the paper-feed table 200 is selectively rotated. The selected paper-feed roller 42 feeds a sheet as the sheet P from a corresponding one of paper-feed cassettes 41 of a paper bank 43. A separation roller 45 separates, if the paper-feed roller 42 feeds several sheets, one from another, and conveys the sheet P to a paper-feed path 46. A conveyer roller 47 conveys the sheet P through the paper-feed path 46 to a paper-feed path in the main body 100. The sheet P is conveyed to a registration roller 49, and then is stopped by the registration roller 49. Alternatively, a paper-feed roller 50 is selectively rotated. The paper-feed roller 50 feeds a sheet from a bypass tray 51 as the sheet P. A separation roller 52 separates, if the paper-feed roller 50 feeds several sheets, one from another, and conveys the sheet P to a bypass paper-feed path 53. The sheet P is conveyed to the registration roller 49, and then is stopped by the registration roller 49 in the same manner.

The registration roller 49 is generally earthed. However, it is allowable to apply a bias to the registration roller 49 to remove paper powder from the sheet P.

After that, the registration roller 49 starts rotating in synchronized with forming of the full-color image on the intermediate transfer belt 13. The registration roller 49 conveys the sheet P to between the intermediate transfer belt 13 and the secondary transfer device 90. Upon receiving the sheet P, the secondary transfer device 90 transfers the full-color image onto the sheet P.

After that, the full-color image is fixed onto the sheet P by the fixing device 74 with the heat and pressure. The sheet P is then conveyed by a conveyer roller 54 to a switching claw 55. If the sheet P is to be ejected, the switching claw 55 leads the sheet P to a path connecting to a copy receiving tray 57. The sheet P is ejected from the main body 100 onto the copy receiving tray 57 by an ejection roller 56. On the other hand, if the second image is to be formed on the back surface of the sheet P, the switching claw 55 leads the sheet P to another path connecting to the sheet reversing device 79. Upon receiving the sheet P, the sheet reversing device 79 reverses the sheet P so that the second image can be formed on the back surface. After that, the sheet P is conveyed to the secondary transfer device 90, and the secondary transfer device 90 transfers the second image onto the back surface of the sheet P. The sheet P with both the first image and the second image is then ejected onto the copy receiving tray 57 by the ejection roller 56.

After the image is transferred onto the sheet P, the intermediate-transfer-belt cleaning device 17 removes the residual toner from the intermediate transfer belt 13. Thus, the intermediate transfer belt 13 is ready for the next image forming by the tandem-type image forming device 12.

The copier according to the ninth embodiment forms the full-color image in the above description. However, the copier can form a black-and-white image with the black toner solely. In forming of the black-and-white image, the intermediate transfer belt 13 is moved away from the photosensitive elements 40Y, 40C, and 40M by a certain device (not shown). The operation of the photosensitive elements 40Y, 40C, and 40M are temporarily stopped. In other words, only the photosensitive drum 40K for black comes in contact with the intermediate transfer belt 13, and performs the image forming and the image transfer.

The sheet conveying device according to any one of the embodiments can be used as a part of the secondary transfer device 90 and the fixing device 74 in the image forming apparatus.

Figure 35:
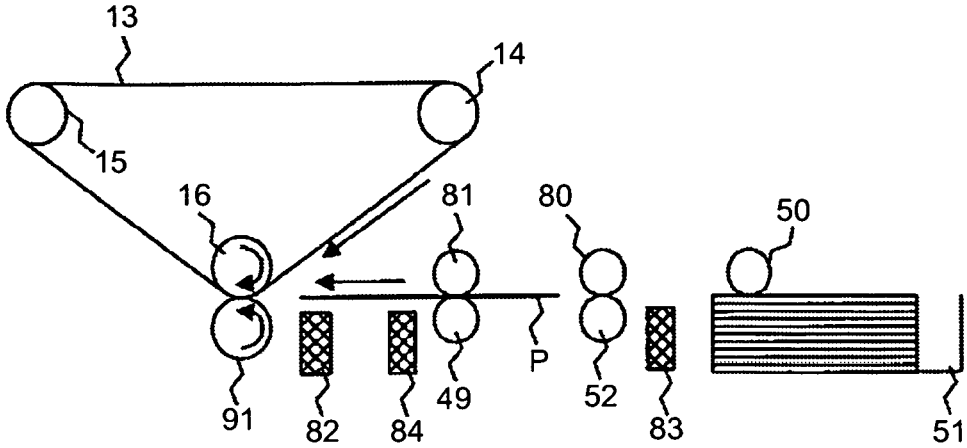
FIG. 35 is a schematic diagram of a sheet conveying device for a secondary transfer device shown in FIG. 34.

FIG. 35 is a schematic diagram of a sheet conveying device for the secondary transfer device 90. The sheet conveying device for the secondary transfer device 90 includes a sheet-position detecting unit 82, a sheet-width measuring unit 83, and a sheet-conveying-speed measuring unit 84 that are used for acquiring data about the sheet P.

It is recommended to arrange the sheet-position detecting unit 82 near the secondary transfer device 90 to suppress fluctuation in timing when the sheet P is fed into the secondary transfer device 90. The sheet-width measuring unit 83 can be located at any position upstream of the secondary transfer device 90. The sheet-conveying-speed measuring unit 84 is located at a position to measure a speed of the sheet P that is being fed into the secondary transfer device 90 as the sheet conveying speed.

If the sheet P is always fed into the secondary transfer device 90 at a fixed speed or the sheet conveying speed is uniquely determined by a parameter such as a printing mode that is selected by the user, it is possible to acquire the sheet-conveying-speed data without actually measuring the conveying speed of the sheet P by the sheet-conveying-speed measuring unit 84. In such cases, the sheet-conveying-speed measuring unit 84 is unnecessary, which reduces the costs. Moreover, it is possible to use an ON/OFF signal of the registration roller 49 instead of the detection signal of the sheet-position detecting unit 82.

Operations of the feedforward control are same as the operations described in the first embodiment to the eighth embodiment, and therefore the same description is not repeated. Although the sheet conveying device shown in FIG. 35 uses the belt as the intermediate transfer medium, it is allowable to use the drum instead of the belt.

Figure 36:
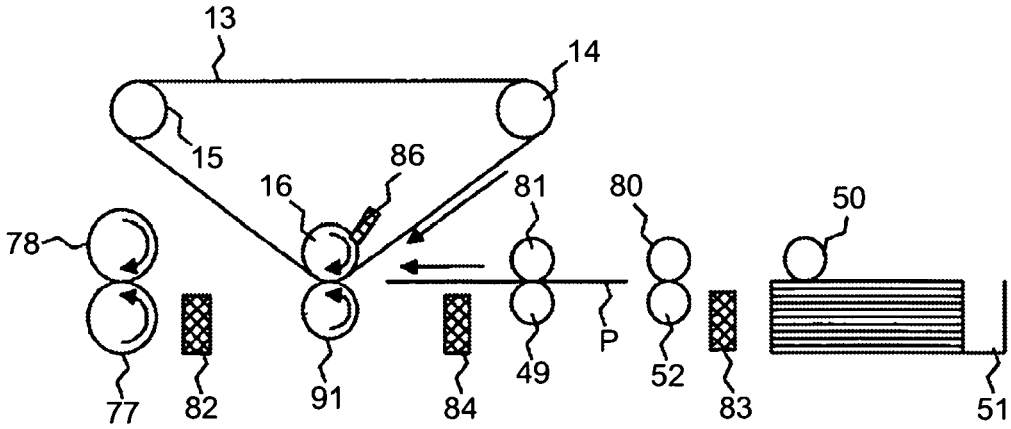
FIG. 36 is a schematic diagram of a sheet conveying device for a fixing device shown in FIG. 34.

FIG. 36 is a schematic diagram of a sheet conveying device for the fixing device 74. The sheet conveying device for the fixing device 74 includes the sheet-position detecting unit 82, the sheet-width measuring unit 83, and the sheet-conveying-speed measuring unit 84 that are used for acquiring data about the sheet P.

It is recommended to arrange the sheet-position detecting unit 82 near the fixing device 74 to suppress fluctuation in timing when the sheet P is fed into the fixing device 74. The sheet-width measuring unit 83 can be located at any position upstream of the fixing device 74. The sheet-conveying-speed measuring unit 84 is located at a position to measure a speed of the sheet P that is being fed into the fixing device 74 as the sheet conveying speed.

If the sheet P is always fed into the fixing device 74 at a fixed speed or the sheet conveying speed is uniquely determined by a parameter such as a printing mode that is selected by the user, it is possible to acquire the sheet-conveying-speed data without actually measuring the conveying speed of the sheet P by the sheet-conveying-speed measuring unit 84. In such cases, the sheet-conveying-speed measuring unit 84 is unnecessary, which reduces the costs. Moreover, if a distance between the fixing device 74 and the registration roller 49 is small, it is possible to use the ON/OFF signal of the registration roller 49 instead of the detection signal of the sheet-position detecting unit 82.

Operations of the feedforward control are same as the operations described in the first embodiment to the eighth embodiment, and therefore the same description is not repeated. Although the sheet conveying device shown in FIG. 36 uses the belt as the intermediate transfer medium, it is allowable to use the roller instead of the belt.

Figure 37:
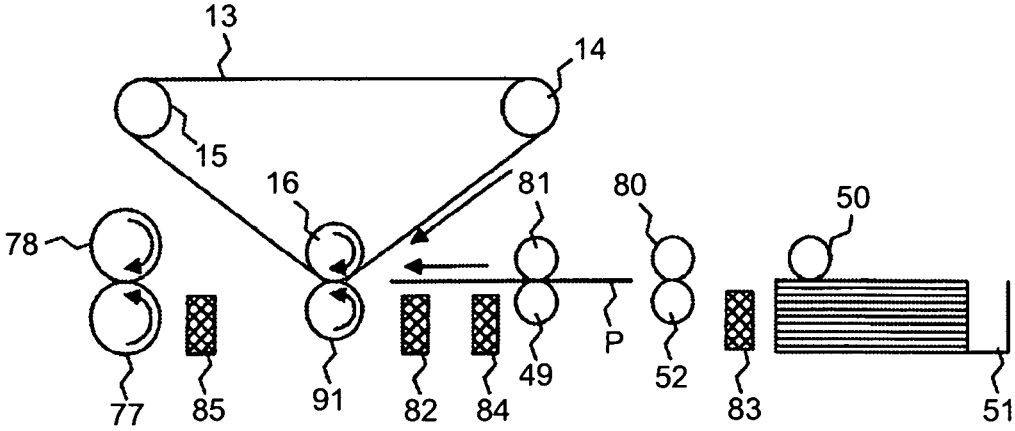
FIG. 37 is a schematic diagram of a sheet conveying device for both the secondary transfer device and the fixing device shown in FIG. 34.

FIG. 37 is a schematic diagram of a sheet conveying device for both the secondary transfer device 90 and the fixing device 74. The sheet conveying device for both the secondary transfer device 90 and the fixing device 74 includes the sheet-position detecting unit 82, a sheet-position detecting unit 85, the sheet-width measuring unit 83, and the sheet-conveying-speed measuring unit 84 that are used for acquiring data about the sheet P.

The sheet-width measuring unit 83 can be located at any position upstream of the secondary transfer device 90. The sheet-conveying-speed measuring unit 84 is located at a position to measure a speed of the sheet P that is being fed into the secondary transfer device 90 as the sheet conveying speed. If the speed of the sheet P that is being fed into the secondary transfer device 90 differs from a speed of the sheet P that is being fed into the fixing device 74 due to a long distance between the secondary transfer device 90 and the fixing device 74, it is necessary to additionally arrange a sheet-conveying-speed measuring unit at a position to measure the speed of the sheet P that is being fed into the fixing device 74. The sheet-position detecting unit 82 is preferably arranged near the secondary transfer device 90 to suppress fluctuation in timing when the sheet P is fed into the secondary transfer device 90, and the sheet-position detecting unit 85 is preferably arranged near the fixing device 74 to suppress fluctuation in timing when the sheet P is fed into the fixing device 74.

If the distance between the secondary transfer device 90 and the fixing device 74 is small, it is possible to measures both timing when the sheet P is fed into the secondary transfer device 90 and timing when the sheet P is fed into the fixing device 74 with the sheet-position detecting unit 82 solely that is located upstream of both the secondary transfer device 90 and the fixing device 74. Moreover, it is possible to use the ON/OFF signal of the registration roller 49 instead of the detection signal of the sheet-position detecting unit 82.

If the sheet P is always fed into the secondary transfer device 90 and the fixing device 74 at a fixed speed or the sheet conveying speed is uniquely determined by a parameter such as a printing mode that is selected by the user, it is possible to acquire the sheet-conveying-speed data without actually measuring the conveying speed of the sheet P by the sheet-conveying-speed measuring unit 84. In such cases, the sheet-conveying-speed measuring unit 84 is unnecessary, which reduces the costs.

Operations of the feedforward control are same as the operations described in the first embodiment to the eighth embodiment, and therefore the same description is not repeated. The structures of the secondary transfer device 90 and the fixing device 74 are not limited to those shown in FIG. 37.

Figure 38:
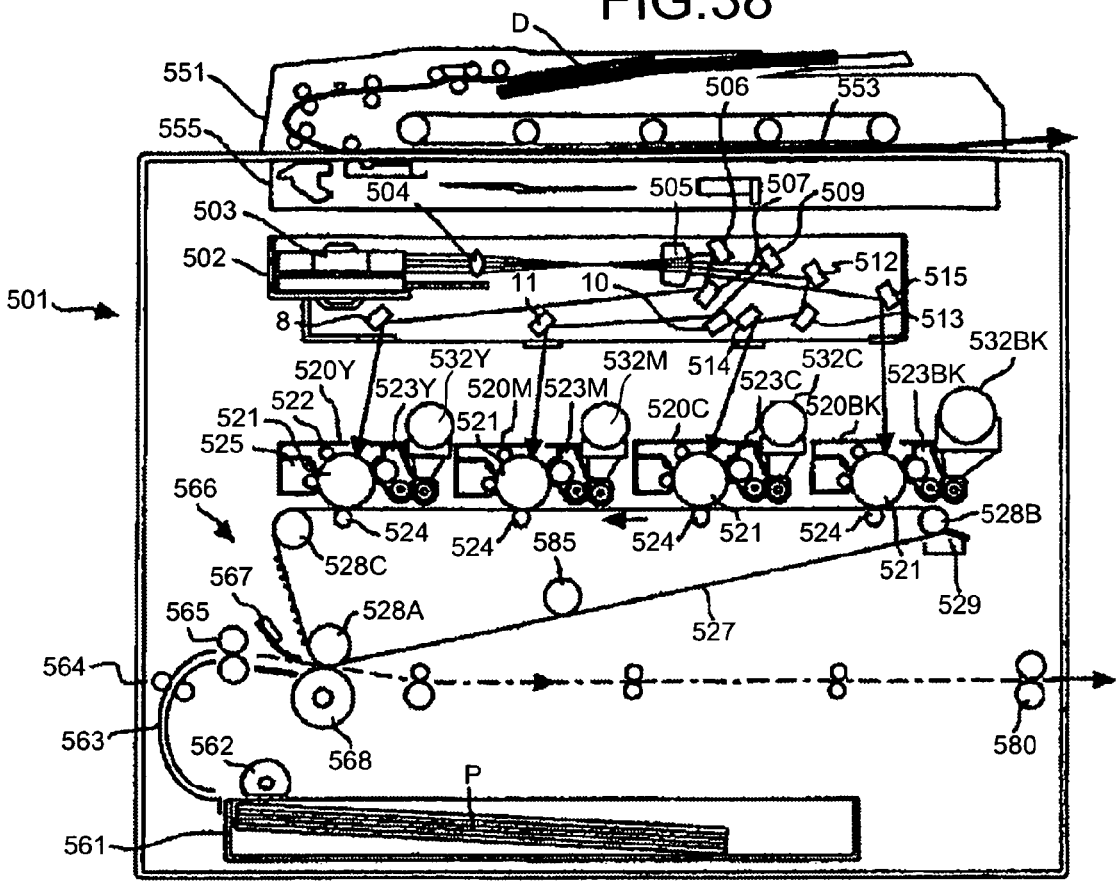
FIG. 38 is a schematic diagram of an image forming apparatus including a transfer fixing device according to a tenth embodiment of the present invention.

FIG. 38 is a schematic diagram of an image forming apparatus including a transfer fixing device 566 according to a tenth embodiment of the present invention. The transfer fixing device 566 transfers the image and, at the same time, fixes the image onto the sheet P. In an image forming process performed by the image forming apparatus according to the tenth embodiment, steps are same as those in the image forming process performed by the copier according to the ninth embodiment except that steps related to the transfer fixing device 566. Therefore, the same description about operations of those units other than the transfer fixing device 566 is not repeated.

The transfer fixing device 566 includes a sheet heater 567, a transfer-fixing roller 528*a*, and a pressure roller 568. Although the sheet heater 567 in the shape of a roller is shown in FIG. 38, a sheet heater in any shape such as a plate can be used as the sheet heater 567. The pressure roller 568 can be in any shape, for example, a pad, a belt, or a roller. The sheet P is conveyed from a paper-feed cassette 561 to the transfer fixing device 566 by the sheet conveying device. In the transfer fixing device 566, a surface of the sheet P is heated to a toner fusion point. The heated sheet P is fed into a nip between the transfer-fixing roller 528*a*, the pressure roller 568, and an intermediate transfer belt 527. The toner of the image on the intermediate transfer belt 527 melts in the heat of sheet P, and the melted toner image is transferred and fixed onto the sheet P by the nip pressure.

Figure 39:
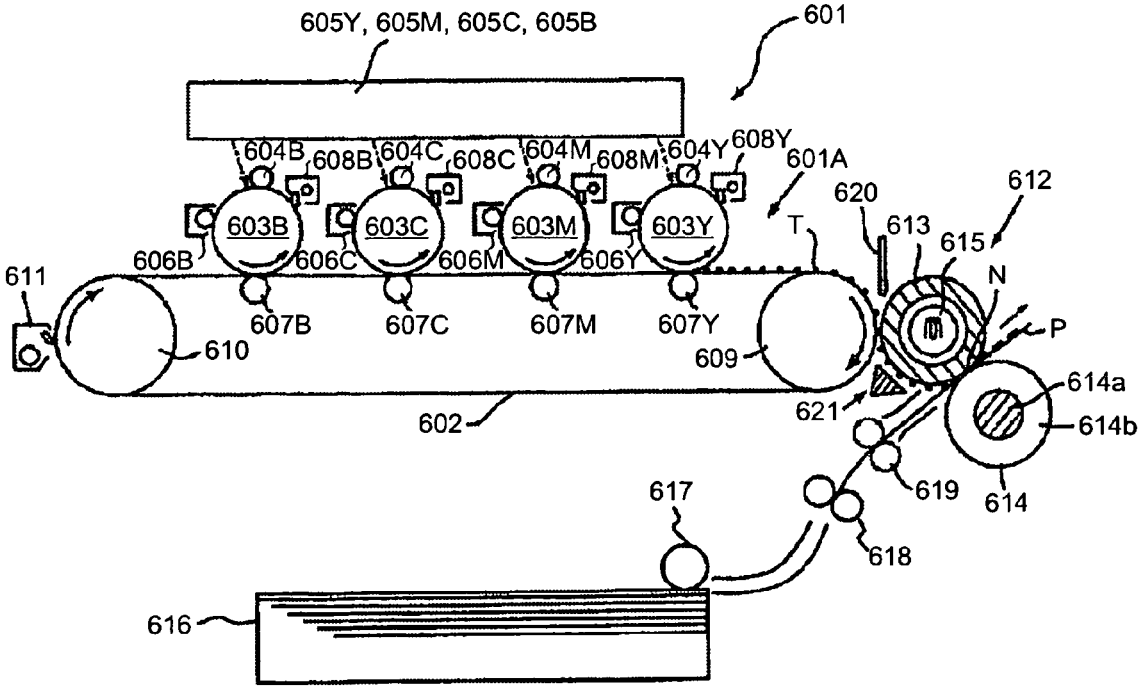
FIG. 39 is a schematic diagram of a transfer fixing device that is different from the transfer fixing device shown in FIG. 38.

FIG. 39 is a schematic diagram of a transfer fixing device 612 that is different from the transfer fixing device 566. The transfer fixing device 612 includes a secondary intermediate transfer medium 613 and a pressure roller 614. The toner image is secondarily transferred from an intermediate transfer belt 602 onto the secondary intermediate transfer medium 613. The secondary intermediate transfer medium 613 includes a heater 615. The heater 615 heats the toner image on a surface of the secondary intermediate transfer medium 613, and thus the toner of the image melts. When the sheet P is fed into a nip between the secondary intermediate transfer medium 613 and the pressure roller 614, the melted toner image is transferred from the secondary intermediate transfer medium 613 onto the sheet P, and is fixed onto the sheet P.

Although the secondary intermediate transfer medium 613 in the shape of a roller is shown in FIG. 39, an intermediate transfer medium in any shape, for example, an endless belt can be used as the secondary intermediate transfer medium 613. Heaters in any shape with any heating system can be used as the heater 615, for example, a halogen heater, a ceramics heater, and an induction heater (IH). The shape and the system of the pressure roller 614 are not limited to the shape and the system shown in FIG. 39.

The sheet conveying device according to any one of the embodiments can be used as a part of the transfer fixing device 612 that is included in the image forming apparatus.

Figure 40:
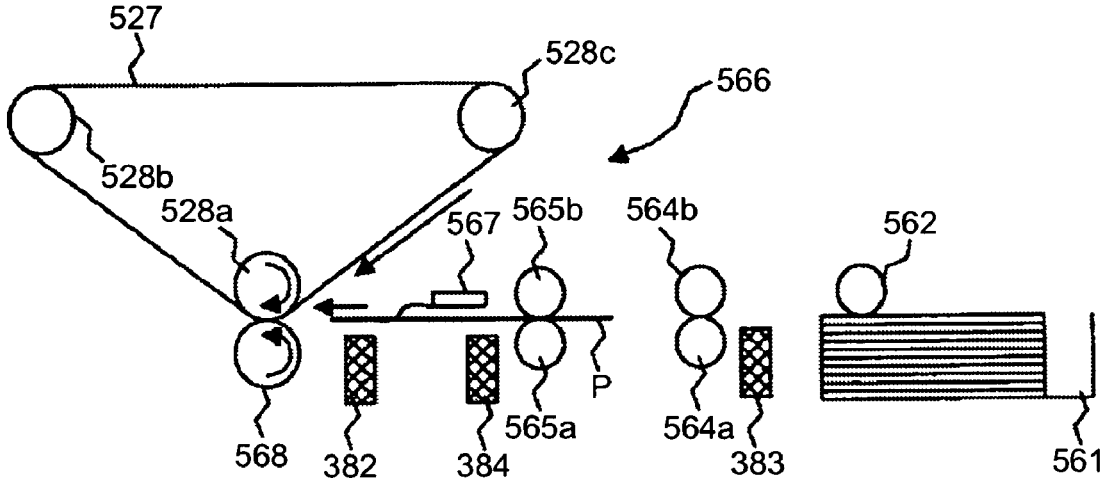
FIG. 40 is a schematic diagram of a sheet conveying device for the transfer fixing device shown in FIG. 38.

FIG. 40 is a schematic diagram of a sheet conveying device for the transfer fixing device 566. Parts corresponding to those in FIG. 38 are denoted with the same reference numerals. The sheet conveying device for the transfer fixing device 566 includes a sheet-position detecting unit 382, a sheet-width measuring unit 383, and a sheet-conveying-speed measuring unit 384. Other necessary parts are same as those of the sheet conveying device for the secondary transfer device 90 shown in FIG. 35, and the same description is not repeated. Operations of the feedforward control are same as the operations described in the first embodiment to the eighth embodiment, and therefore the same description is not repeated.

Figure 41:
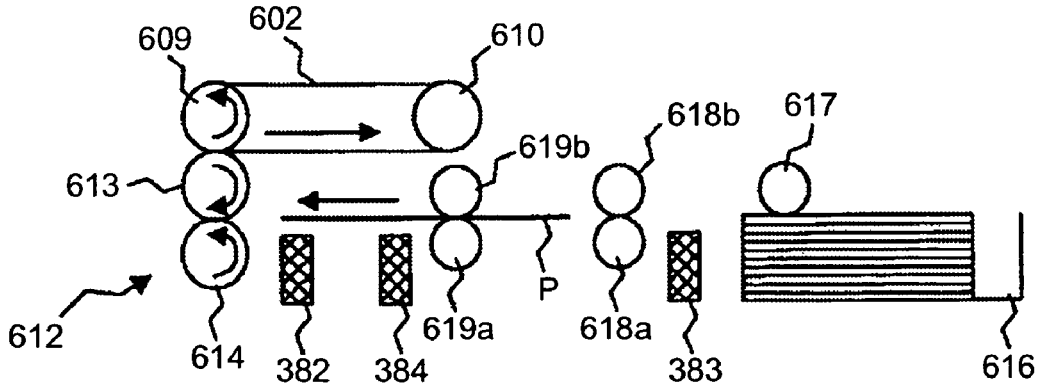
FIG. 41 is a schematic diagram of a sheet conveying device for the transfer fixing device shown in FIG. 39.

FIG. 41 is a schematic diagram of a sheet conveying device for the transfer fixing device 612 that is different from the transfer fixing device 566. The sheet conveying device for the transfer fixing device 612 includes the sheet-position detecting unit 382, the sheet-width measuring unit 383, and the sheet-conveying-speed measuring unit 384. Other necessary parts are same as those of the sheet conveying device for secondary transfer device 90 shown in FIG. 35, and the same description is not repeated. Operations of the feedforward control are same as the operations described in the first embodiment to the eighth embodiment except that the speed compensation is for the secondary intermediate transfer medium 613. Therefore, the same description is not repeated. Although the secondary intermediate transfer medium 613 in the shape of a roller is shown in FIG. 41, a belt can be used as the secondary intermediate transfer medium 613.

According to an aspect of the present invention, a sheet conveying device conveys a sheet in such a manner that an expected fluctuation in a rotating speed of a first rotary member occurring when the sheet is fed into a nip between the first rotary member and a second rotary member is accurately compensated in consideration of a width of the sheet.

Moreover, the expected fluctuation is compensated accurately in consideration of a conveying speed of the sheet.

Furthermore, the expected fluctuation is compensated accurately in consideration of all the width, a thickness, the conveying speed of the sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device including a first rotary member having a surface configured to make an endless movement, a second rotary member having a surface configured to make an endless movement being arranged opposite to the surface of the first rotary member, and a driving unit configured to drive the first rotary member, the sheet conveying device configured to convey a sheet by nipping it in a nip formed by bringing the surface of the first rotary member and the surface of the second rotary member into contact, the sheet conveying device comprising:

a sheet-width measuring unit to measure a width of the sheet perpendicular to a direction of conveying the sheet;

a sheet position detecting unit to detect the sheet, the sheet position detecting unit being arranged between the sheet-width measuring unit and the first rotary member; and a speed compensating unit to compensate a fluctuation of a rotation speed of the first rotary member occurring when the sheet is fed into the nip, wherein the speed compensating unit is configured to adjust a compensation target value for compensating the fluctuation of the rotation speed of the first rotary member based on the width of the sheet measured by the sheet-width measuring unit, the sheet position detecting unit is configured to send a detection signal to the speed compensating unit, and the speed compensating unit is configured to output the compensation target value after receiving the detection signal.

2. The sheet conveying device according to claim 1, further comprising;

a sheet-thickness measuring unit to measure a thickness of the sheet, wherein the speed compensating unit is further configured to adjust the compensation target value based on the width of the sheet measured by the sheet-width measuring unit and the thickness of the sheet measured by the sheet-thickness measuring unit.

3. The sheet conveying device according to claim 2, further comprising:

a conveying-speed measuring unit to measure a conveying speed of the sheet, wherein the speed compensating unit is further configured to adjust the compensation target value based on the width of the sheet measured by the sheet-width measuring unit, the thickness of the sheet measured by the sheet-thickness measuring unit, and the conveying speed measured by the conveying-speed measuring unit.

4. The sheet conveying device according to claim 3, wherein the speed compensating unit does not compensate the fluctuation of the rotation speed of the first rotary member when the thickness of the sheet measured by the sheet-thickness measuring unit is below a first value and the conveying speed measured by the conveying-speed measuring unit is below a second value.

5. The sheet conveying device according to claim 3, wherein the speed compensating unit does not compensate the fluctuation of the rotation speed of the first rotary member when the width of the sheet measured by the sheet-width measuring unit is below a first value, the thickness of the sheet measured by the sheet-thickness measuring unit is below a second value and the conveying speed measured by the conveying-speed measuring unit is below a third value.

6. The sheet conveying device according to claim 2, wherein the speed compensating unit does not compensate the fluctuation of the rotation speed of the first rotary member when the thickness of the sheet measured by the sheet-thickness measuring unit is below a value.

7. The sheet conveying device according to claim 2, wherein the speed compensating unit does not compensate the fluctuation of the rotation speed of the first rotary member when the width of the sheet measured by the sheet-width measuring unit is below a first value and the thickness of the sheet measured by the sheet-thickness measuring unit is below a second value.

8. The sheet conveying device according to claim 1, further comprising:

a conveying-speed measuring unit to measure a conveying speed of the sheet, wherein the speed compensating unit is further configured to adjust the compensation target value based on the width of the sheet measured by the sheet-width measuring unit and the conveying speed measured by the conveying-speed measuring unit.

9. The sheet conveying device according to claim 8, wherein the speed compensating unit does not compensate the fluctuation of the rotation speed of the first rotary member when the conveying speed measured by the conveying-speed measuring unit is below a value.

10. The sheet conveying device according to claim 8, wherein the speed compensating unit does not compensate the fluctuation of the rotation speed of the first rotary member when the width of the sheet measured by the sheet-width measuring unit is below a first value and the conveying speed measured by the conveying-speed measuring unit is below a second value.

11. The sheet conveying device according to claim 1, wherein the speed compensating unit does not compensate the fluctuation of the rotation speed of the first rotary member when the width of the sheet measured by the sheet-width measuring unit is below a value.

12. The sheet conveying device according to claim 1, wherein the speed compensating unit includes a feedforward control unit to perform a feedforward control, and the compensation target value is a target value of the feedforward control.

13. An image forming apparatus comprising:

an image carrier on which a toner image is formed;

a transfer unit to transfer the toner image from the image carrier onto a sheet; and a fixing unit to fix the toner image transferred onto the sheet, wherein at least one of the transfer unit and the fixing unit includes the sheet conveying device according to claim 1.

* * * * *